US009624063B2

(12) United States Patent
Coenen et al.

(10) Patent No.: US 9,624,063 B2
(45) Date of Patent: Apr. 18, 2017

(54) FOLDING APPARATUS AND METHOD OF FOLDING A PRODUCT USING AN OSCILLATING MEMBER AND A FOLDING ROLL

(71) Applicant: Kimberly-Clark Worldwide, Inc., Neenah, WI (US)

(72) Inventors: Joseph Daniel Coenen, Kaukauna, WI (US); Gerald Sosalla, Appleton, WI (US); Gregory J. Rajala, Neenah, WI (US); John Soosai Alphonse, Tamil Nadu (IN); Mohammed Shafi Khurieshi, Andhra Pradesh (IN); Mahendra Mittapalli, Andhra Pradesh (IN)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 474 days.

(21) Appl. No.: 14/089,026

(22) Filed: Nov. 25, 2013

(65) Prior Publication Data

US 2014/0171284 A1 Jun. 19, 2014

Related U.S. Application Data

(62) Division of application No. 12/971,999, filed on Dec. 17, 2010, now Pat. No. 8,617,040.

(51) Int. Cl.

| | |
|---|---|
| ***B65H 45/16*** | (2006.01) |
| ***B65H 45/12*** | (2006.01) |
| *B65H 45/04* | (2006.01) |

(52) U.S. Cl.

CPC ..... *B65H 45/12* (2013.01); *B65H 45/16* (2013.01); *B65H 45/04* (2013.01); *B65H 2406/33* (2013.01); *B65H 2801/57* (2013.01)

(58) Field of Classification Search

CPC ..... B65H 45/16; B65H 45/18; B65H 20/26; B65H 20/12; B65H 45/04

(Continued)

(56) References Cited

U.S. PATENT DOCUMENTS

| | | | |
|---|---|---|---|
| 2,137,978 | A | 11/1938 | Mills et al. |
| 2,957,512 | A | 10/1960 | Wade et al. |

(Continued)

FOREIGN PATENT DOCUMENTS

| | | |
|---|---|---|
| JP | 8188950 | 7/1996 |
| WO | 2009083788 | 7/2009 |

OTHER PUBLICATIONS

International Search Report and Written Opinion for PCT/IB2011/055056 dated Jun. 18, 2012; 8 pages.

*Primary Examiner* — Christopher Harmon

(74) *Attorney, Agent, or Firm* — Armstrong Teasdale LLP

(57) ABSTRACT

An apparatus for folding products includes a conveying member adapted to convey the product, an oscillating member disposed adjacent the conveying member, and a folding roll disposed adjacent the conveying member and the oscillating member. The oscillating member is adapted to grasp and lift a first portion of the product from the conveying member while the product is being conveyed by the conveying member. The oscillating member is moveable in a first direction away from the conveying member and in a second direction toward the conveying member. The folding roll is adapted to receive the first portion of the product from the oscillating member and to place the first portion of the product into engagement with a second portion of the product such that the product is in a folded configuration.

11 Claims, 39 Drawing Sheets

(58) Field of Classification Search
USPC ..... 493/442, 424, 434–436, 454
See application file for complete search history.

(56) References Cited

U.S. PATENT DOCUMENTS

| | | | | |
|---|---|---|---|---|
| 3,953,638 | A | 4/1976 | Kemp | |
| 4,053,150 | A | 10/1977 | Lane | |
| 4,259,220 | A | 3/1981 | Bunnell et al. | |
| 4,519,596 | A | 5/1985 | Johnson et al. | |
| 4,535,407 | A | 8/1985 | Eckert et al. | |
| 4,606,964 | A | 8/1986 | Wideman | |
| 4,650,173 | A | 3/1987 | Johnson et al. | |
| 4,652,487 | A | 3/1987 | Morman | |
| 4,666,139 | A * | 5/1987 | Filewich | B65H 45/167 270/52.14 |
| 4,717,375 | A * | 1/1988 | Lundmark | A61F 13/15747 493/357 |
| 5,090,671 | A * | 2/1992 | Gombault | B65H 45/14 270/45 |
| 5,334,446 | A | 8/1994 | Quantrille et al. | |
| 5,882,769 | A | 3/1999 | McCormack et al. | |
| 5,904,802 | A * | 5/1999 | Niedermeyer | A41H 42/00 156/226 |
| 6,057,024 | A | 5/2000 | Mleziva et al. | |
| 6,209,867 | B1 | 4/2001 | Madsen et al. | |
| 6,383,124 | B1 * | 5/2002 | St. Germain | B65H 45/165 493/353 |
| 6,630,096 | B2 | 10/2003 | Venturino et al. | |
| 7,399,266 | B2 | 7/2008 | Aiolfi et al. | |
| 7,758,486 | B2 * | 7/2010 | Ochsenbauer | B31F 1/0019 270/42 |
| 7,846,082 | B2 | 12/2010 | Burns, Jr. et al. | |
| 7,955,244 | B2 * | 6/2011 | Burns, Jr. | A61F 13/15764 493/418 |
| 8,257,237 | B2 * | 9/2012 | Burns, Jr. | A61F 13/15764 493/418 |
| 8,602,198 | B2 | 12/2013 | Coenen et al. | |
| 8,617,040 | B2 | 12/2013 | Coenen et al. | |
| 2002/0016122 | A1 | 2/2002 | Curro et al. | |
| 2003/0042660 | A1 | 3/2003 | Venturino et al. | |
| 2003/0226862 | A1 | 12/2003 | Vogt et al. | |
| 2005/0073090 | A1 | 4/2005 | White | |
| 2006/0266465 | A1 | 11/2006 | Meyer | |
| 2006/0276320 | A1 * | 12/2006 | Aiolfi | B65B 63/045 493/441 |
| 2008/0176729 | A1 | 7/2008 | Anelli et al. | |
| 2009/0098995 | A1 * | 4/2009 | Burns, Jr. | A61F 13/15764 493/440 |
| 2012/0157284 | A1 | 6/2012 | Coenen et al. | |
| 2012/0157286 | A1 | 6/2012 | Coenen et al. | |

* cited by examiner

FOLDING APPARATUS AND METHOD OF FOLDING A PRODUCT USING AN OSCILLATING MEMBER AND A FOLDING ROLL

CROSS-REFERENCE TO RELATED APPLICATION

This application is a divisional application of U.S. patent application Ser. No. 12/971,999 entitled Folding Apparatus and Method of Folding a Product, filed Dec. 17, 2010, which is incorporated herein by reference in its entirety.

BACKGROUND

The field of the present invention relates generally to apparatus and methods for folding products and more particularly, to apparatus and methods for folding products with increased alignment control at relatively high line speeds.

One known technology used to fold products as they proceed through a product manufacturing system is "blade folding". Blade folding involves striking a discrete, moving product at a desired location with a blade to form a "bite" in the product. The bite is directed into a set of in-running conveyor belts to fold portions of the product. Examples of such blade folding apparatus and methods of their use are described in U.S. Pat. No. 4,053,150 to Lane; U.S. Pat. No. 4,519,596 to Johnson et al.; and U.S. Pat. No. 4,650,173 to Johnson et al. Various products can be folded using blade folding apparatus including disposable personal care products. Disposable personal care products are well known and include diapers, training pants, adult incontinence garments, feminine pads, bed liners, pet-care mats, dinner napkins, toweling, chair liners, etc.

One disadvantage of known blade folding technology is that the precision and repeatability of the folds in the products is dependent upon the timing of when the blade strikes the moving product as well as the traction of the in-running belts to the product bite. Plus, blade folding requires that the product is "free" when it is struck by the blade. Thus, there is a period of time in the folding process when a leading portion of the product is not held in place, and as a result, is not under direct positioning control. These features of blade folding are undesirable when precise fold positioning is needed, particularly at high speeds, such as speeds ranging from 400 products per minute to 4000 products per minute, depending on the product being folded.

Another disadvantage of blade folding is the "cudgeling effect". That is, the bludgeoning force of the blade striking the product can result in deformed products, damaged products, poor folding alignment, poor folding repeatability, as well as other undesirable results.

Thus, there is a need for a folding apparatus and method of folding products at high speeds where the products can be folded in repeatable alignment at high speeds. There is a further need for apparatus and methods for folding products without the resulting deformation, damage and/or other undesirable effects inherent in current blade folding apparatus and methods.

BRIEF DESCRIPTION

In one aspect, an apparatus for folding products generally comprises a conveying member adapted to convey the product, an oscillating member disposed adjacent the conveying member, and a folding roll disposed adjacent the conveying member and the oscillating member. The oscillating member is adapted to grasp and lift a first portion of the product from the conveying member while the product is being conveyed by the conveying member. The oscillating member is moveable in a first direction away from the conveying member and in a second direction toward the conveying member. The folding roll is adapted to receive the first portion of the product from the oscillating member and to place the first portion of the product into engagement with a second portion of the product such that the product is in a folded configuration.

In another aspect, a method of folding a product generally comprises directing the product along a conveying member at a conveying speed. The product has a first portion, a second portion, and a fold axis separating the first portion and the second portion. The first portion of the product is lifted from the conveying member with an oscillating member while the product is being conveyed by the conveying member and the oscillating member is rotating in a first rotational direction. The first portion of the product is transferred to a folding roll rotating in the first rotational direction. The first portion of the product is transferred from the folding roll to the conveying member such that the first portion of the product is in overlying relationship with the second portion and the product is folded generally along the fold axis.

BRIEF DESCRIPTION OF THE DRAWINGS

Corresponding reference characters indicate corresponding parts throughout the drawings.

DETAILED DESCRIPTION OF THE DRAWINGS

Figure 1:
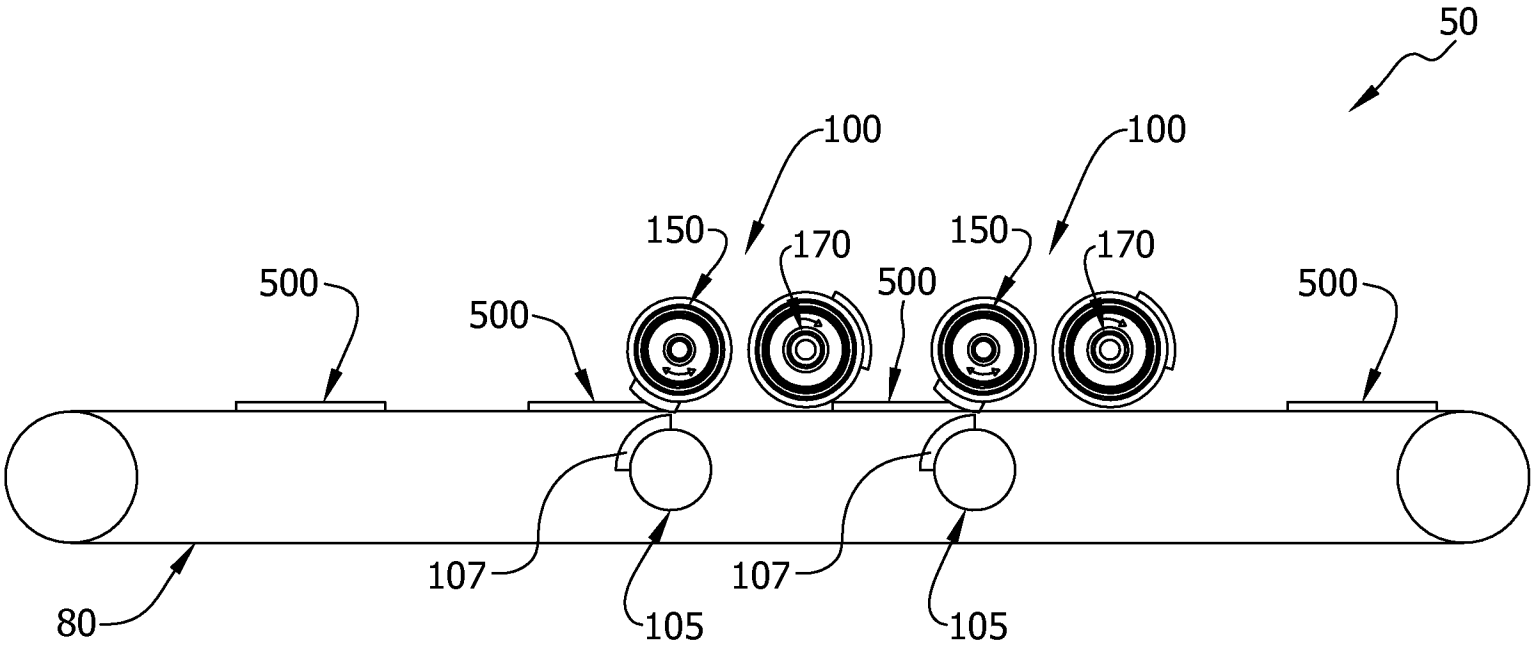
FIG. 1 is a schematic of a portion of a folding system for folding products, the folding system having two folding apparatus of one suitable embodiment.

FIG. 1 is a schematic of folding system, indicated generally at 50, for folding products (such as personal care products) having one embodiment of a folding apparatus, indicated generally at 100. The illustrated configuration of the folding system 50 has two folding apparatus 100 but it is contemplated that the system could have fewer (i.e., one) or more folding apparatus. The folding apparatus 100 is capable of maintaining accurate control of the product while it is being folded at high line speeds. As a result, the products being manufactured by the illustrated system 50 are folded more precisely, with greater repeatability, and with less force (and thus less product damage and deformation) than prior art folding apparatus, such as blade folding apparatus. As used herein, the term "high line speed" refers to product manufacturing rates of 400 products per minute (ppm) or greater, such as 400 ppm to 4000 ppm, or 600 ppm to 3000 ppm, or 900 ppm to 1500 ppm. However, it is understood that the product manufacturing rate is directly dependent on the product being manufactured. Thus, the term "high line speed" is relative and can differ from one product to another.

For exemplary purposes only, the illustrated folding system 50 and thus, the folding apparatus 100 will be described herein as a disposable training pant folding system and folding apparatus. It is understood, however, that the folding system 50 can be configured to fold numerous other products, including but not limited to, other types of personal care products, foil products, film products, woven products, packaging products, industrial products, food products, etc., whether disposable or non-disposable, and whether absorbent or non-absorbent, without departing from the scope of the invention. Other suitable personal care products that could be folded by the system 50 include, but are not limited to, diapers, adult incontinence garments, panty liners, and feminine pads.

As illustrated in FIG. 1, a plurality of discrete training pants 500 are fed along a conveying member, indicated generally at 80, to each of the folding apparatus 100. The conveying member 80 delivers each of the training pants 500 in a pre-folded configuration to one of the two folding apparatus 100 for folding the training pants from the pre-folded configuration to a folded configuration. The folded training pants 500 are then conveyed from the respective folding apparatus 100 by the conveying member 80. Since both of the folding apparatus 100 illustrated in FIG. 1 are substantially the same, the detailed description of only one is provided herein.

Figure 2:
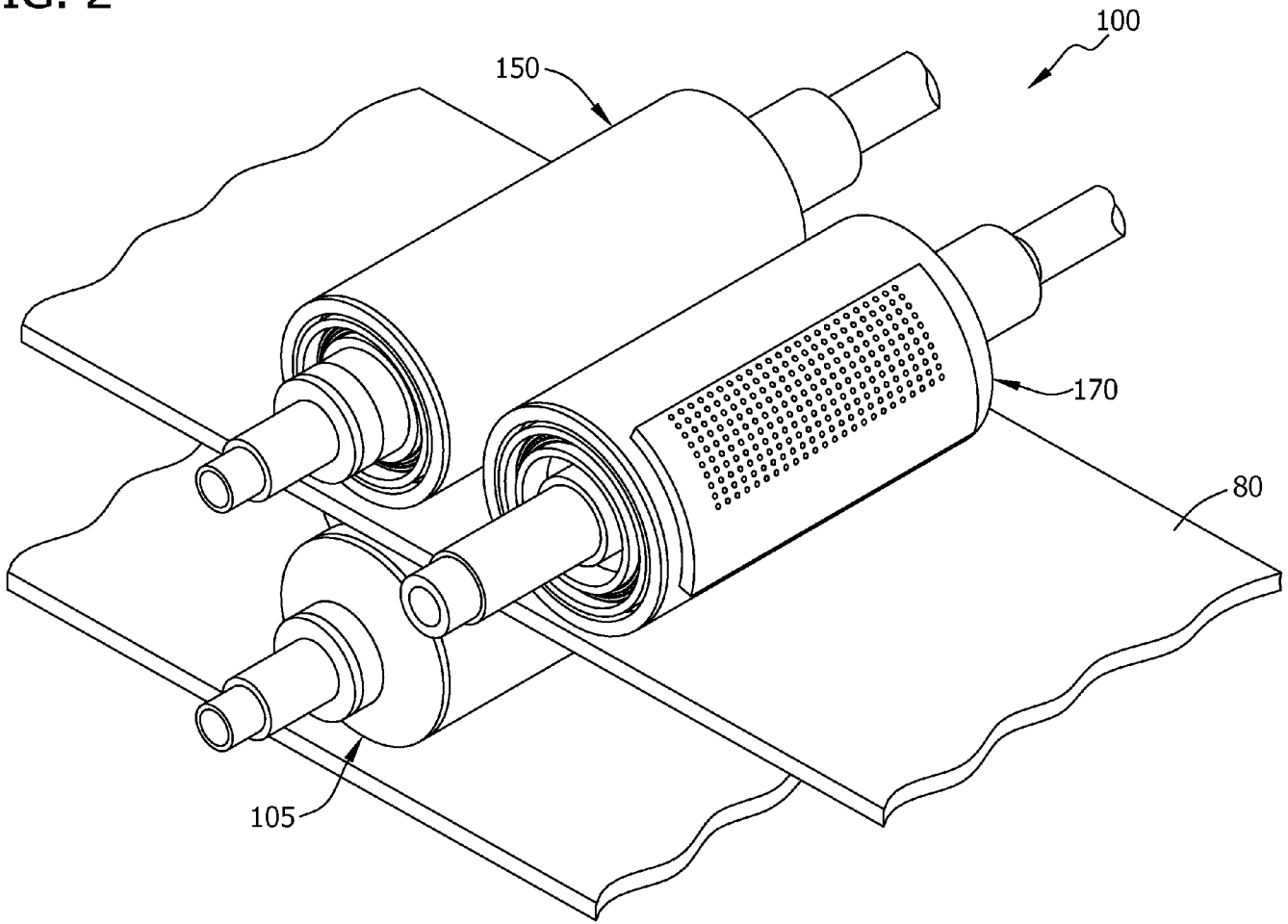
FIG. 2 is a perspective of one of the folding apparatus removed from the folding system, the folding apparatus having an oscillating member and a folding roll.
Figure 3:
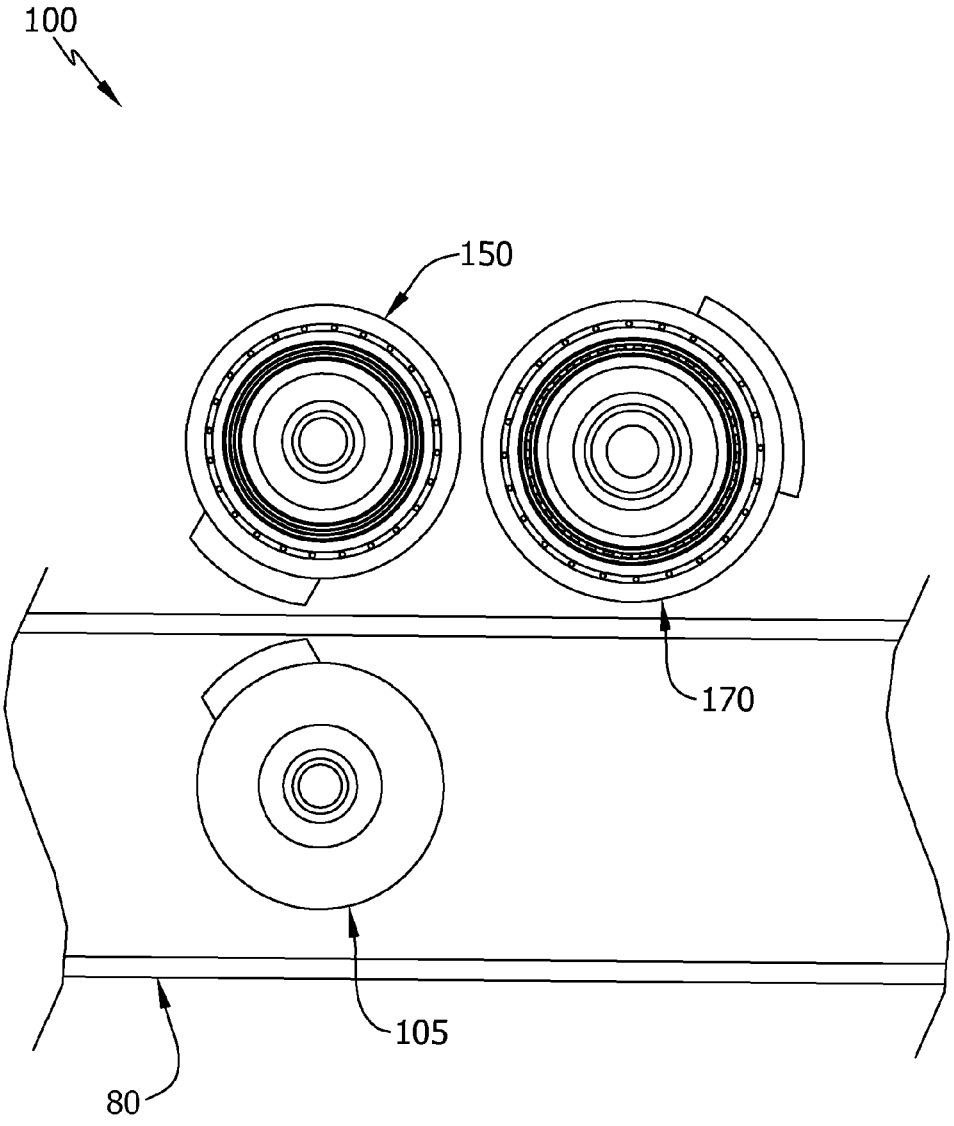
FIG. 3 is an end view of the folding apparatus of FIG. 2.

As illustrated in FIG. 1-3, the folding apparatus 100 comprises the conveying member 80, an oscillating member, indicated generally at 150, a folding roll, indicated generally at 170, and a bump roll, indicated generally at 105. The oscillating member 150 and the folding roll 170 collectively define a folding assembly. Devices suitable for use as the conveying member 80 are well-known in the art and include, but are not limited to, drums, rollers, belt conveyors, air conveyors, vacuum conveyors, chutes, and the like. For exemplary purposes, the conveying member 80 is illustrated herein as a vacuum belt conveyor. In one suitable embodiment, the conveying member 80 includes a conveying-assist device (not shown) to assist in keeping the training pants in a controlled position during advancement. Conveying-assist means are well-known in the art and, for example, include support belts, vacuum means, support rolls, secondary conveyor belts, guide plates, and the like.

Figure 4:
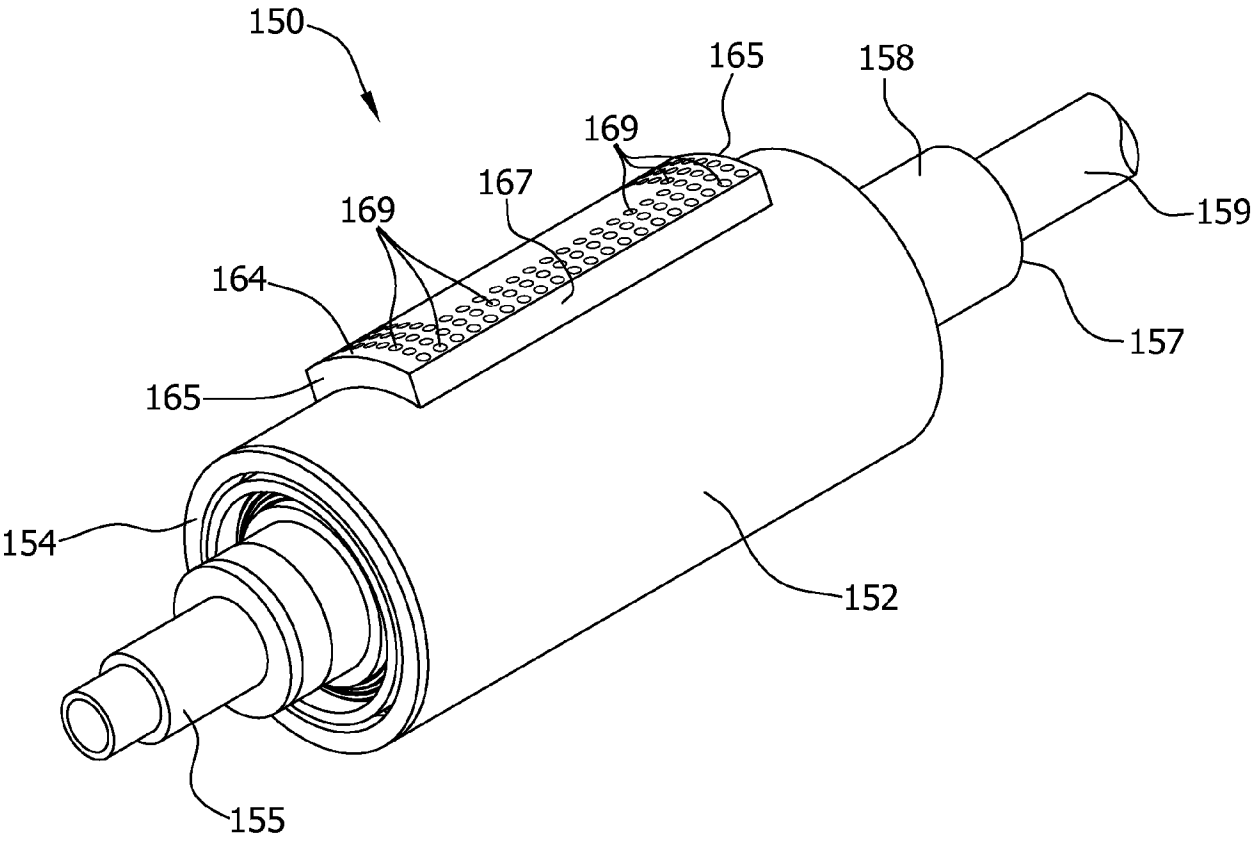
FIG. 4 is a perspective of the oscillating member of the folding apparatus.
Figure 5:
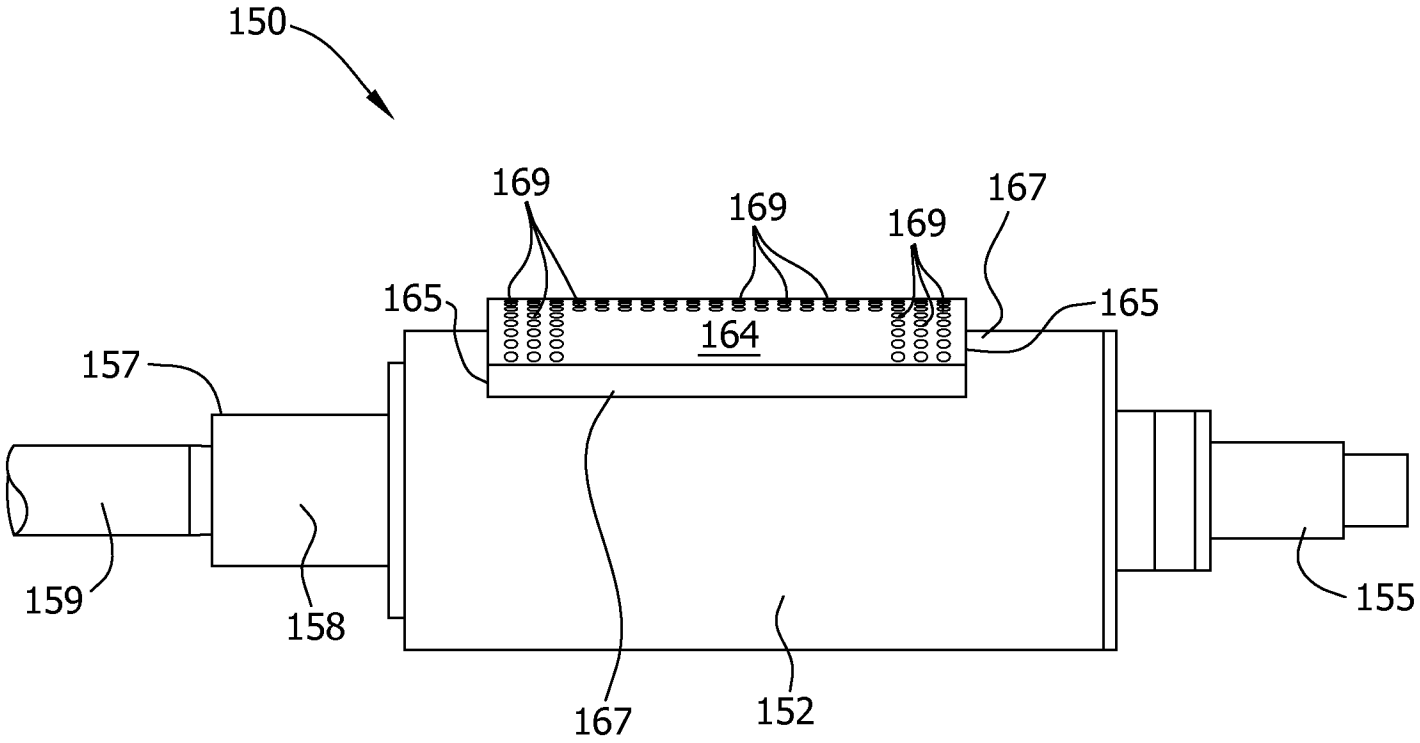
FIG. 5 is a left side view of the oscillating member as seen in FIG. 4.
Figure 6:
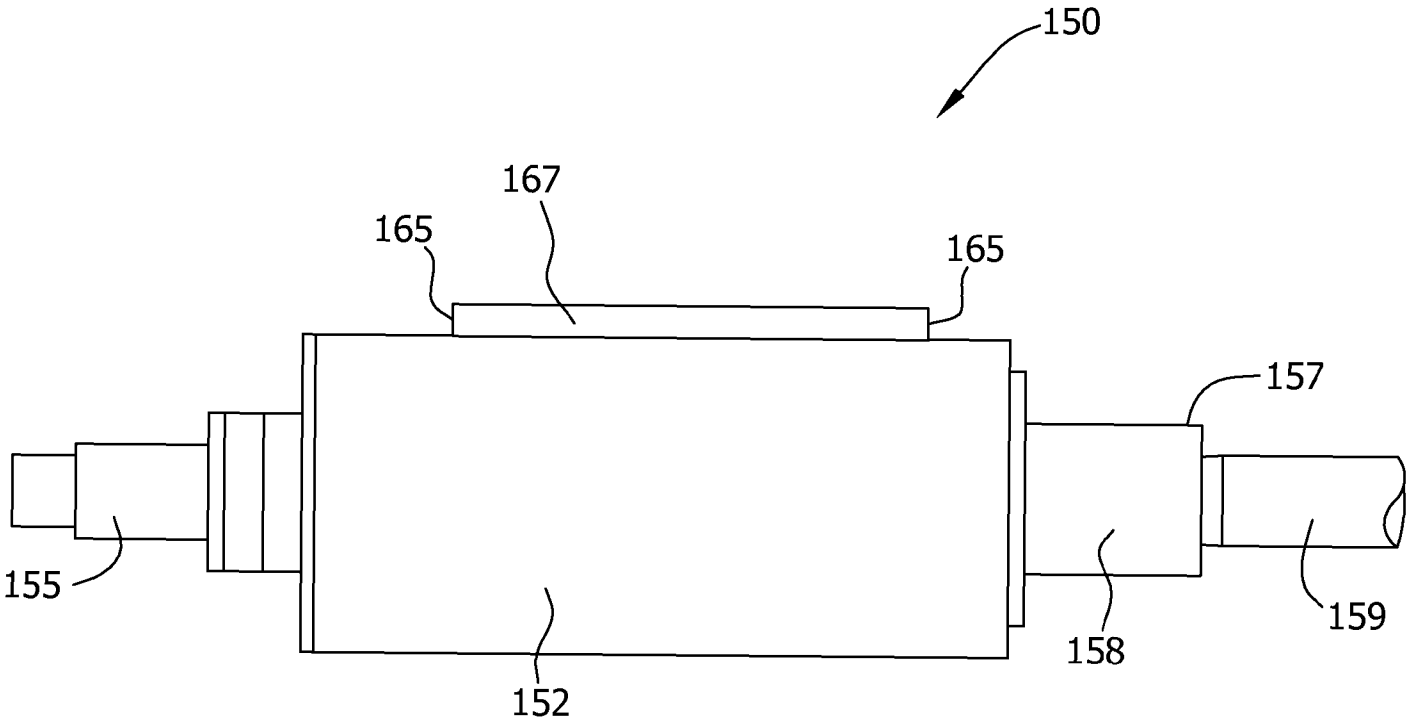
FIG. 6 is a right side view of the oscillating member.
Figure 7:
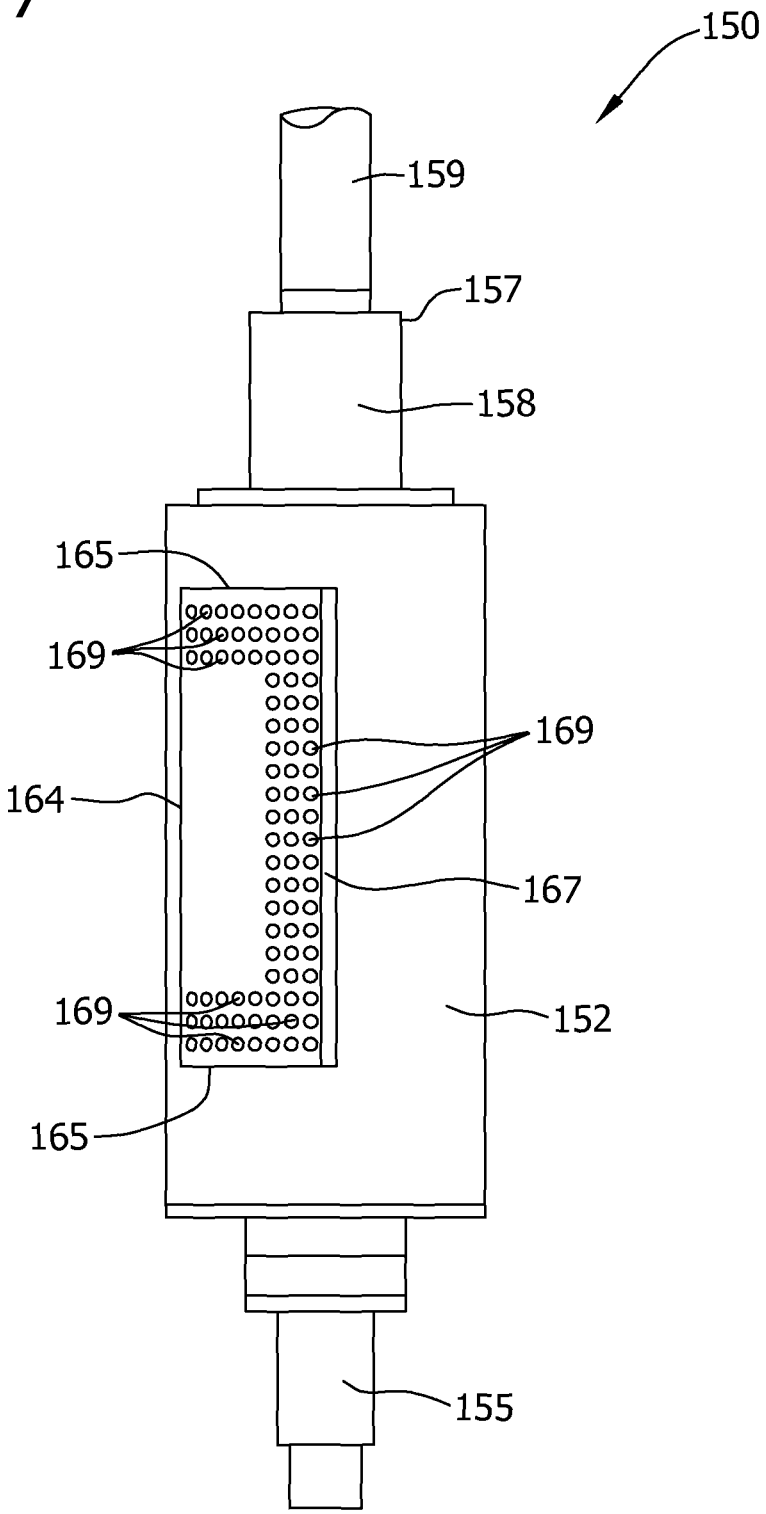
FIG. 7 is a top elevation of the oscillating member.
Figure 8:
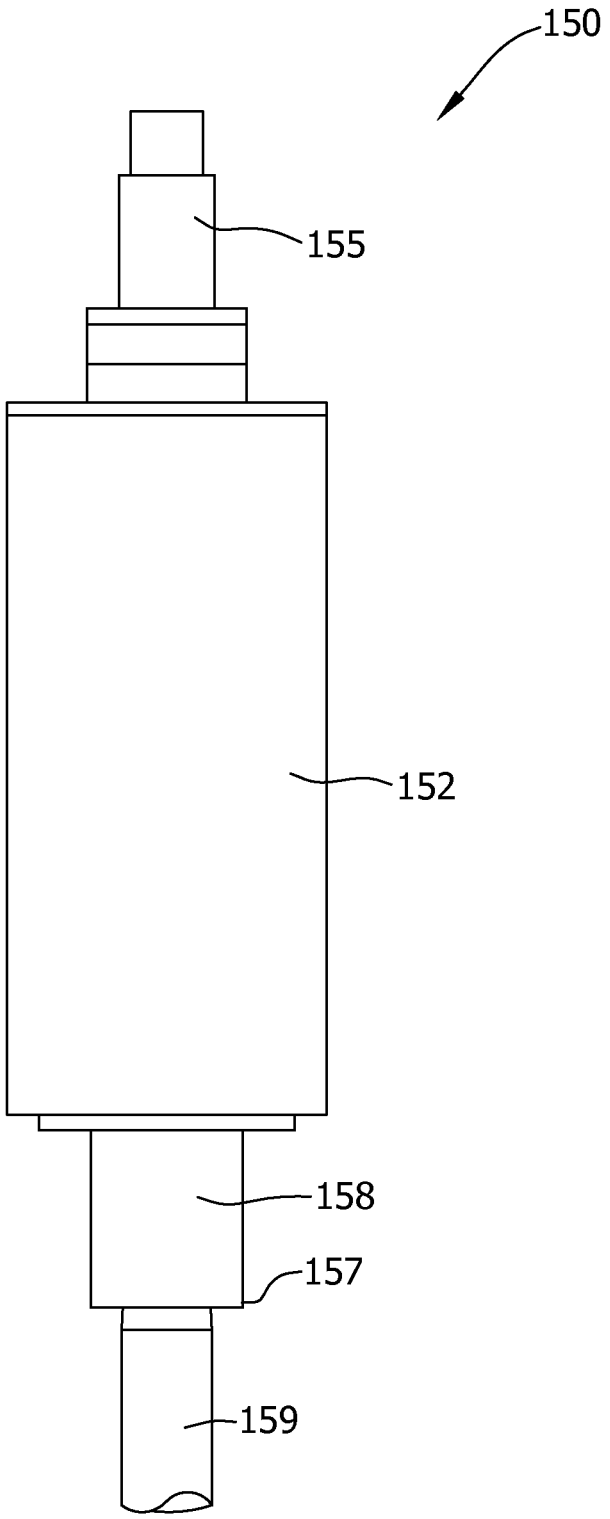
FIG. 8 is a bottom elevation of the oscillating member.
Figure 9:
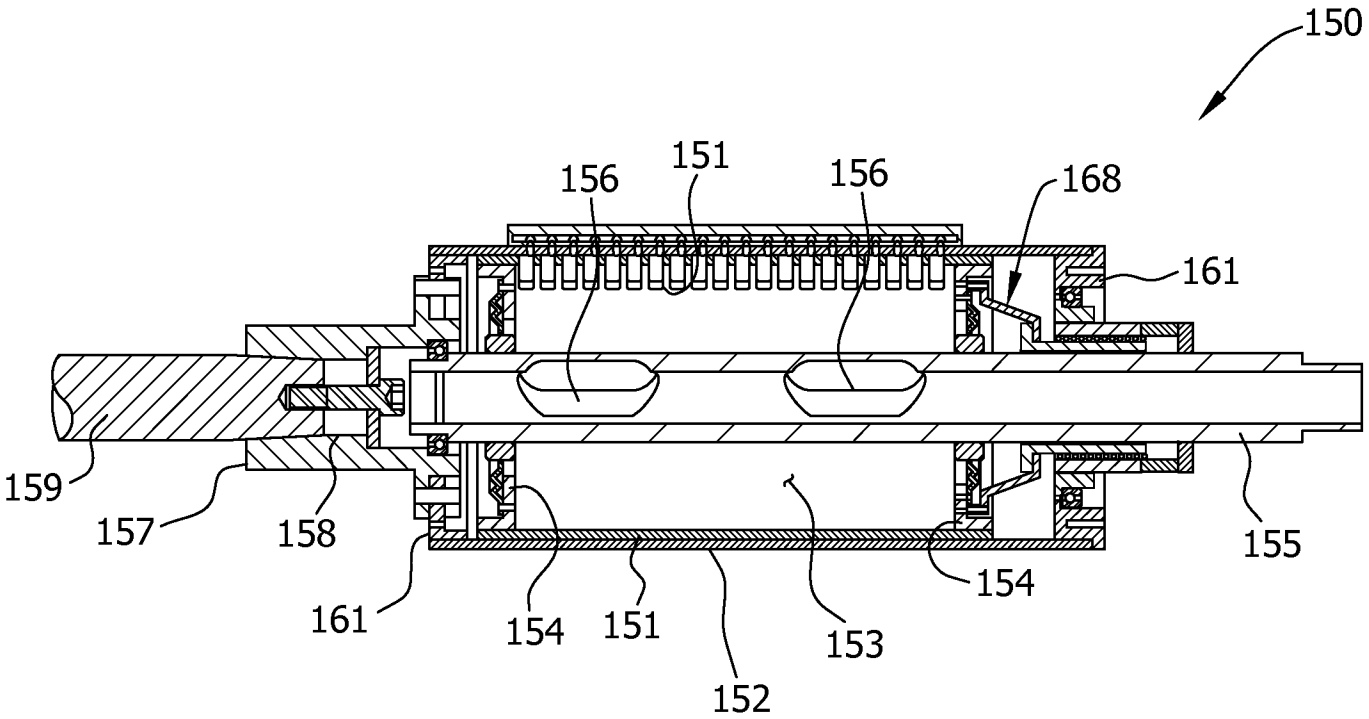
FIG. 9 is a vertical cross-section of the oscillating member.

With reference to now to FIGS. 4-14, the oscillating member 150 comprises an inner cylinder 151 and an outer cylinder 152 that is rotatable about the inner cylinder. As seen in FIGS. 4 and 5, the outer cylinder 152 comprises a raised puck 164 adapted to receive a portion of the training pant 500 from the conveying member 80 and to transfer the portion to the folding roll 170. The puck 164 includes a pair of lateral sides 165, a pair of longitudinal sides 167, and a plurality of circular apertures 169 arranged generally adjacent the lateral sides and one of the longitudinal sides. As a result, a portion of the puck 164 is free of apertures 169. The outer cylinder 152 is closed by a pair of end plates 161 (FIG. 9).

It is understood that the puck 164 can be flush with the remainder of the outer cylinder 152 of the oscillating member 150 (i.e., not raised). It is further understood that the apertures 169 in the puck 164 of the outer cylinder 152 can be arranged differently, that there could be more or fewer apertures than illustrated in the accompanying drawings, and that the apertures can have different shapes and sizes than those illustrated. It is also understood that the inner and outer cylinders could be other shapes that provide concentric surfaces such as partial spheres, cones, a stepped series of cylinders, or partials of the above since the oscillating member does not need to rotate 360 degrees.

Figure 10:
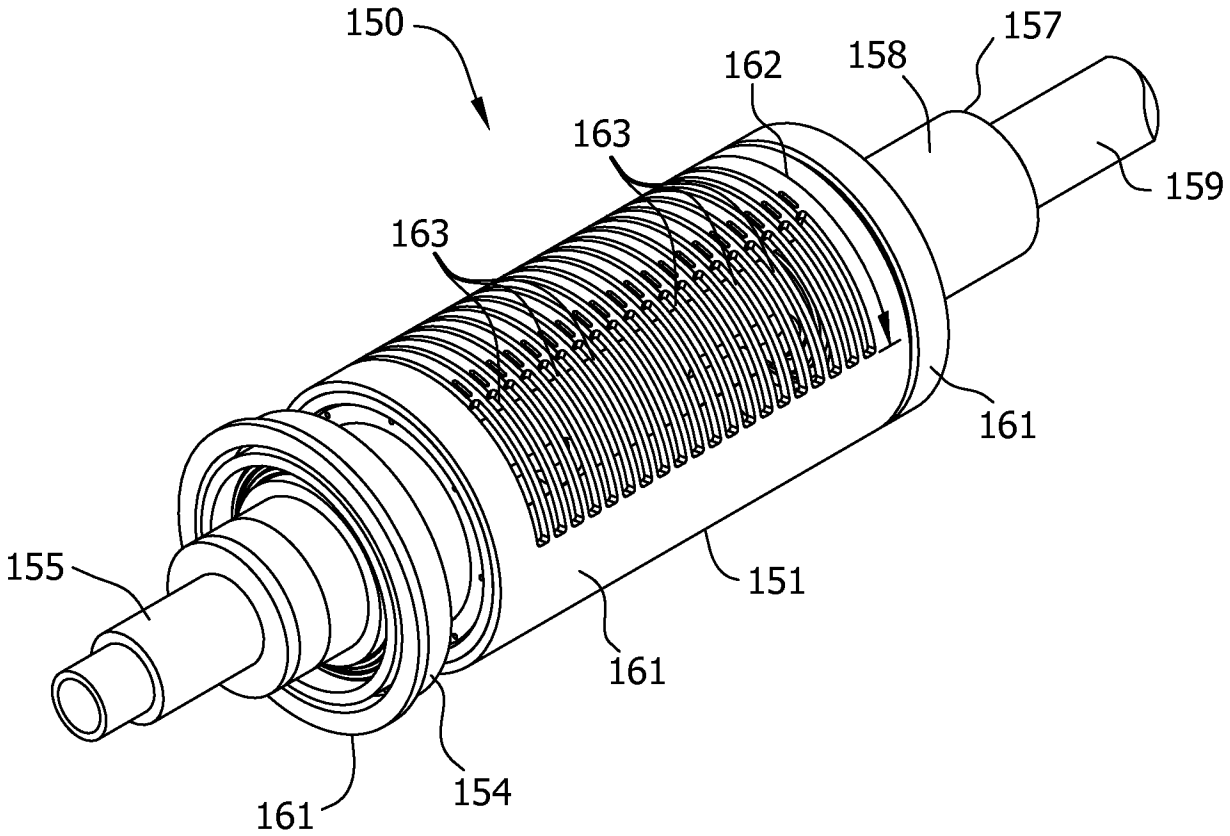
FIG. 10 is a perspective of the oscillating member with an outer cylinder of the oscillating member removed.
Figure 11:
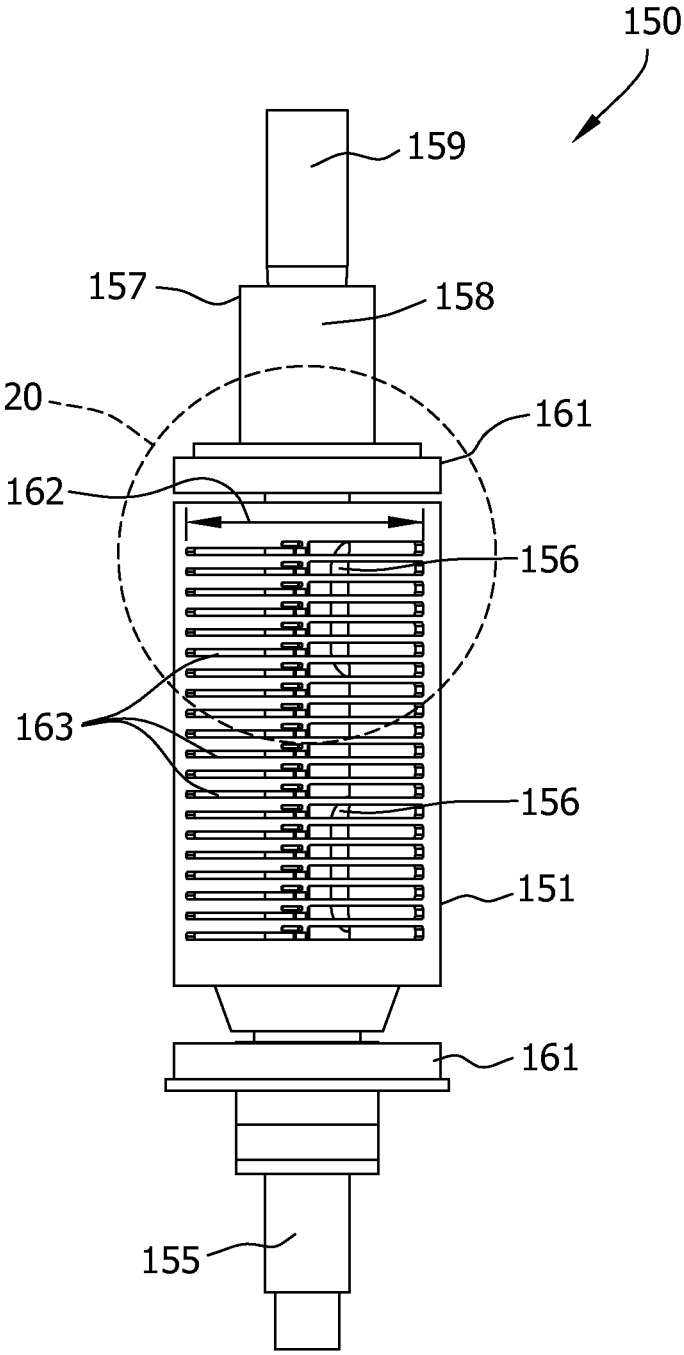
FIG. 11 is a top elevation of the oscillating member with the outer cylinder removed as seen in FIG. 10.
Figure 12:
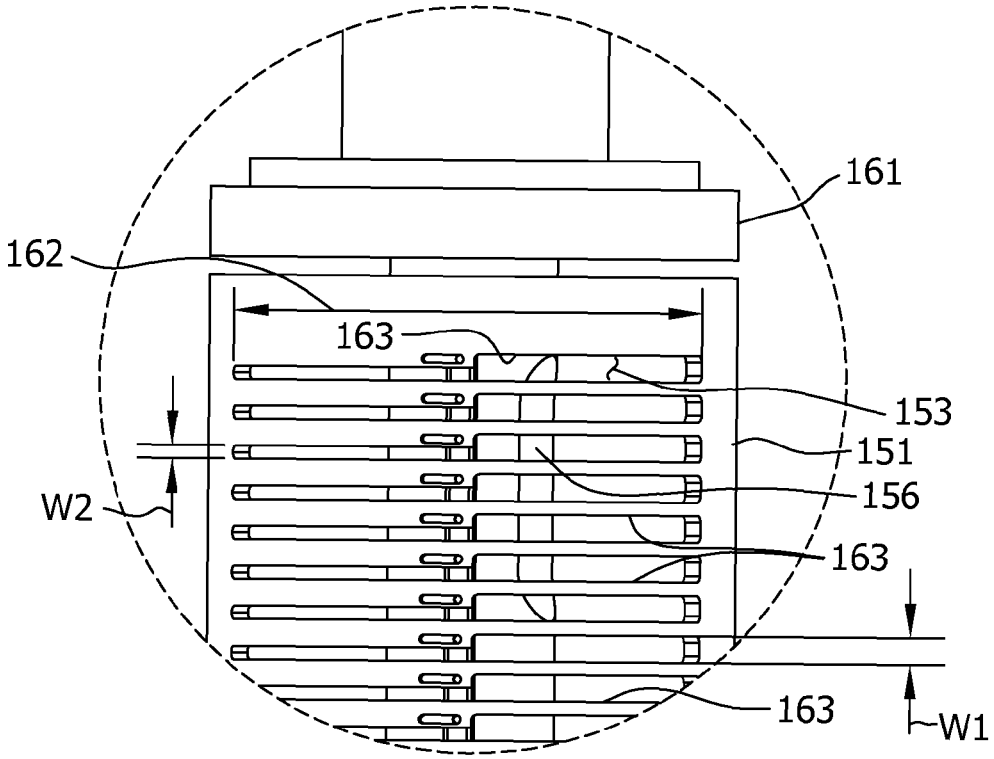
FIG. 12 is an enlarged view of a portion of the oscillating member of FIG. 11.

In the illustrated embodiment, the inner cylinder 151 does not rotate and defines an interior chamber 153 (FIG. 9). With reference to FIGS. 10-12, the inner cylinder 151 comprises a wall 161 having a slotted segment 162 with a plurality of slots 163. Each of the slots 163 varies along its length from a first width W1 to a narrower second width W2 (FIG. 12). In the illustrated embodiment, for example, the first width W1 is approximately twice as wide as the second width W2. It is understood, however, that the relative difference between the first and second widths can be different.

A pair of end plates 154 is disposed adjacent the ends of the inner cylinder 151 and closes the interior chamber 153 (FIG. 9). A conduit 155 extends into and is in fluid communication with the interior chamber 153 for allowing a suitable vacuum source (not shown) to apply a vacuum thereto. In one suitable embodiment, the conduit 155 extends through the interior chamber 153 and has a pair of oval openings 156 that open within the interior chamber (FIG. 9). It is understood that the conduit 155 may extend only partially into the interior chamber 153 and that the openings 156 in the conduit can vary in shape, size and number.

A drive assembly 157 is operatively connected to the outer cylinder 152 for rotating the outer cylinder with respect to the inner cylinder 151. The drive assembly 157 includes a hub 158, a shaft 159 coupled to the hub and a suitable drive mechanism (not shown) capable of rotating the shaft and the hub. In the illustrated embodiment, the drive assembly 157 is variable and is capable of rotating the outer cylinder 152 at variable speeds and in both a clockwise direction and a counterclockwise direction.

Figure 13:
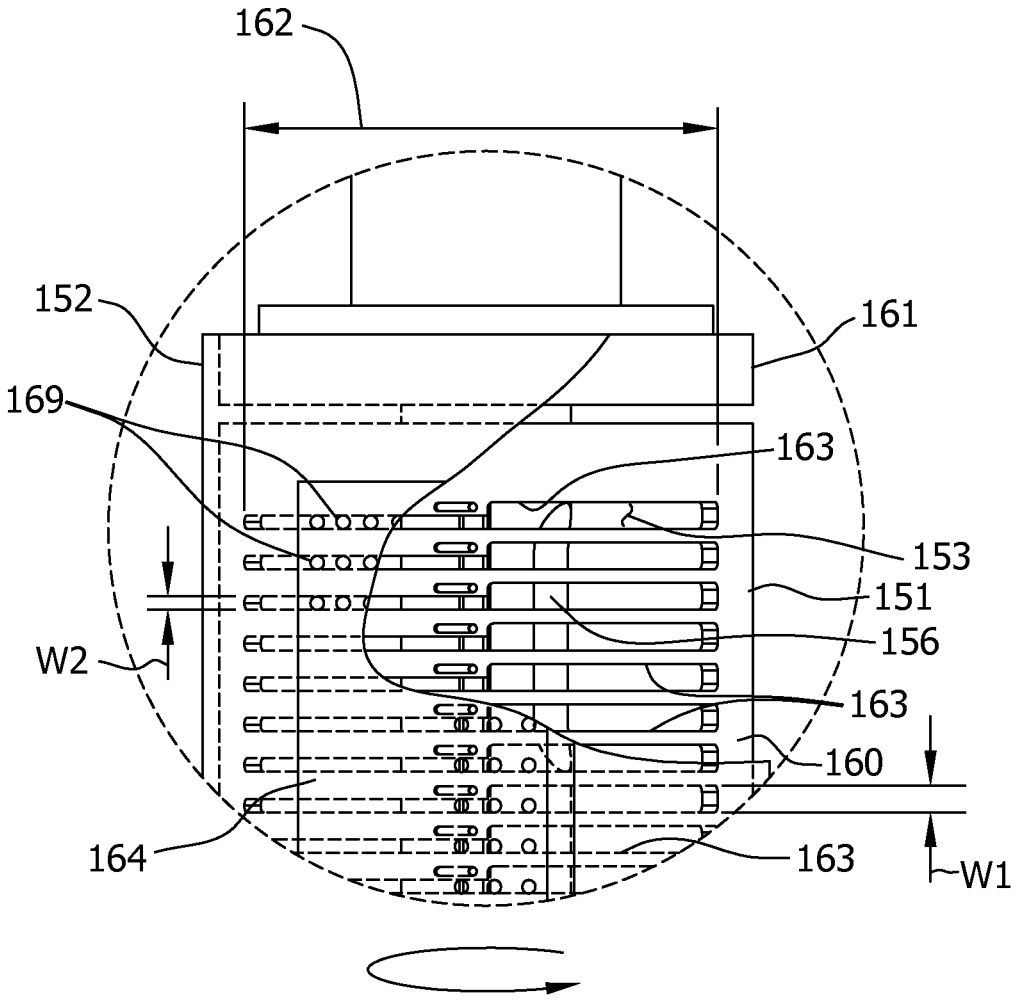
FIG. 13 is a view similar to FIG. 12 but showing the outer cylinder overlying the inner cylinder, the inner cylinder being in a first position and a portion of the outer cylinder being cut away.
Figure 14:
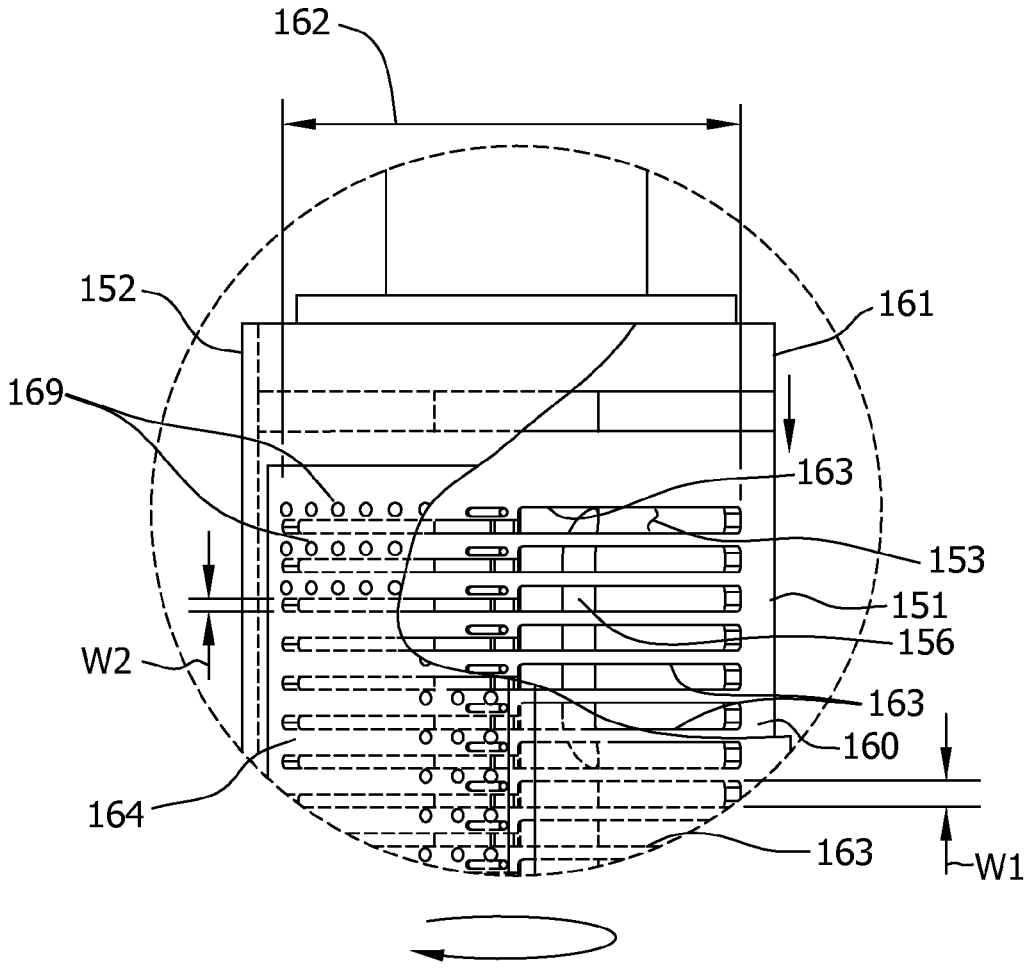
FIG. 14 is a view similar to FIG. 13 but showing the inner cylinder moved relative to the outer cylinder to a second position.
Figure 15:
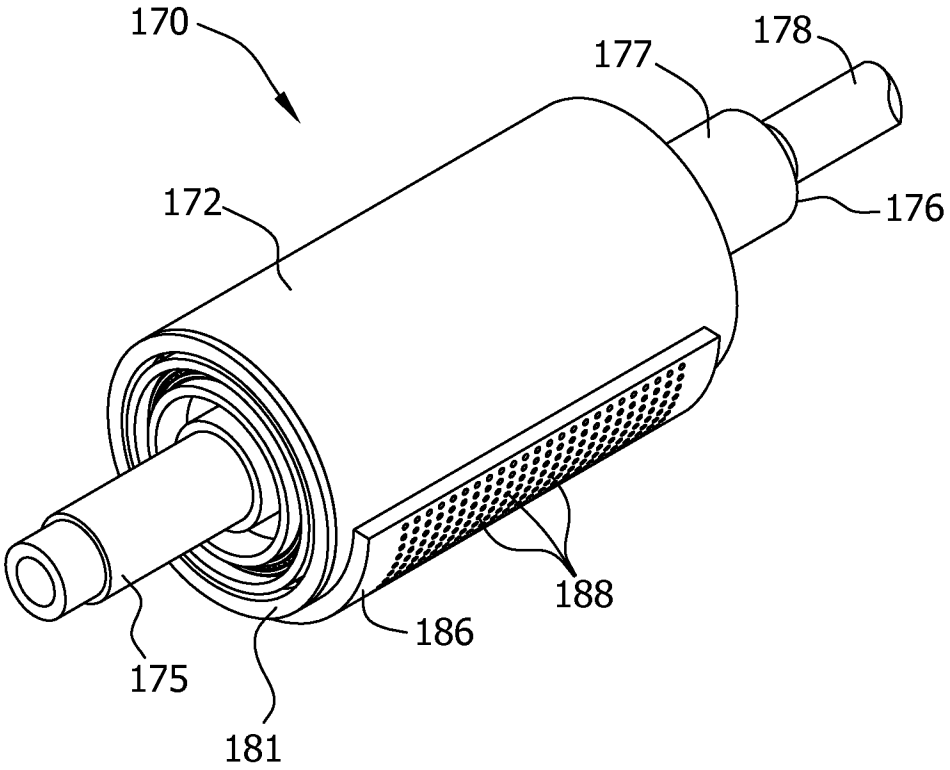
FIG. 15 is a perspective of the folding roll of the folding apparatus.

With reference now to FIGS. 9, 13 and 14, an actuator 168 is provided for translating the inner cylinder 151 axially with respect to the outer cylinder 152 from a first position to a second position. In the first position, which is illustrated in FIG. 13, the apertures 169 in the puck 164 of the oscillating member 150 are aligned with the slots 163 in the slotted segment 162 of the inner cylinder 151 along their entire length. That is, the apertures 169 in the puck 164 align with both the narrower and wider portions of the slots 163 in the inner cylinder 151. In the second position, however, the apertures 169 in the puck 164 of the oscillating member 150 only align with the wider portion of slots 163 (FIG. 14). Thus, the apertures 169 in the puck 164 of the oscillating member 150 do not align with the narrower portions of the slots 163 when the inner cylinder is in the second position.

As a result, the oscillating member 150 has a first vacuum profile with the inner cylinder 151 in the first position, and a second vacuum profile with the inner cylinder in the second position. That is, the vacuum is turned on and off at different points by the oscillating member 150 when the inner cylinder is in the first position as compared to when the inner cylinder is in the second position.

In the illustrated embodiment, the actuator 168 comprises a voice coil motor (FIG. 9). The voice coil motor is capable of developing force in either direction depending upon the polarity of the current applied thereto. Thus, the voice coil motor is capable of braking, damping, and holding forces. In one suitable embodiment, the voice coil motor is capable of displacing more than 15 mm at frequencies up to 40 or 50 Hz. In the illustrated embodiment, for example, the input current is preset so that the voice coil motor displaces the inner cylinder 151 approximately 5 millimeters (mm) relative to the outer cylinder 152. More specifically, the inner cylinder 151 is illustrated in the first position in FIGS. 9 and 13, which corresponds to the normal position of the voice coil motor. When the preset input current is applied to the voice coil motor, the voice coil motor acts on the inner cylinder 151 to translate the inner cylinder approximately 5 mm with respect to the outer cylinder 152. In other words, the voice coil motor moves the inner cylinder 151 to the second position (FIG. 14). It is contemplated that the inner cylinder 151 can move more or less than 5 mm with respect to the outer cylinder 152. It is understood that other types of suitable actuators besides voice coil motors can be used to move the inner cylinder 151 relative to the outer cylinder 152.

Figure 16:
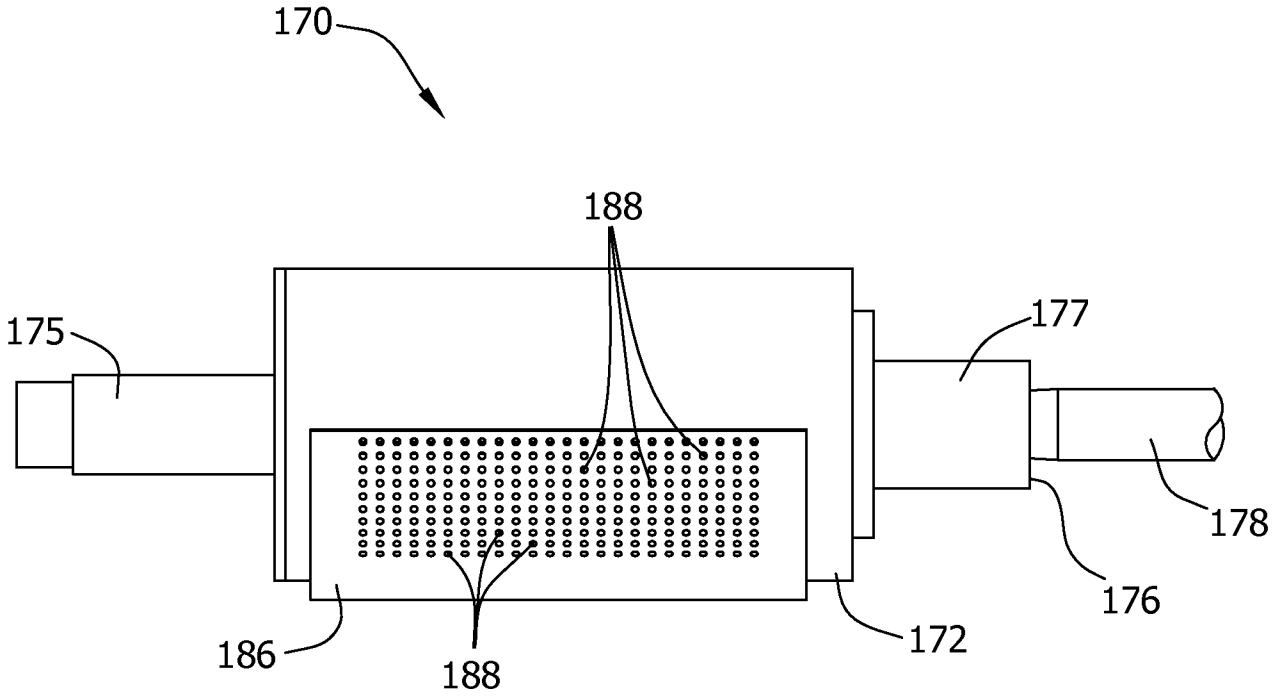
FIG. 16 is a right side view of the folding roll as seen in FIG. 15.
Figure 17:
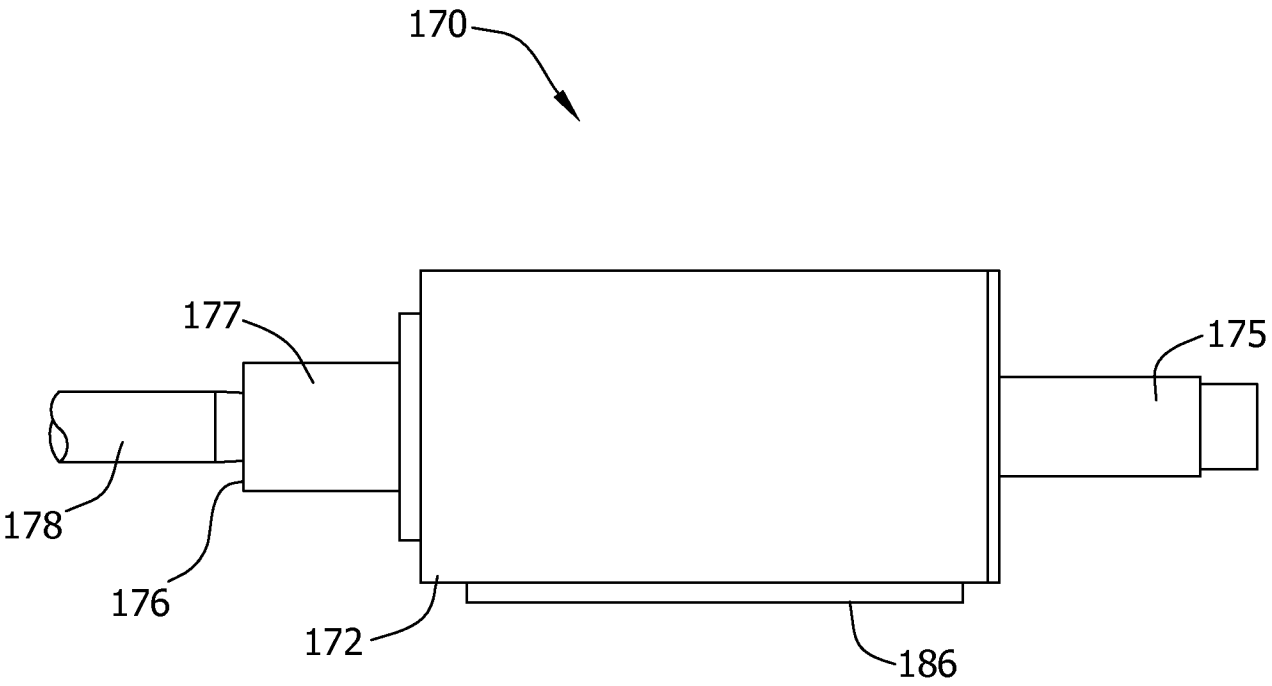
FIG. 17 is a left side view of the folding roll.
Figure 18:
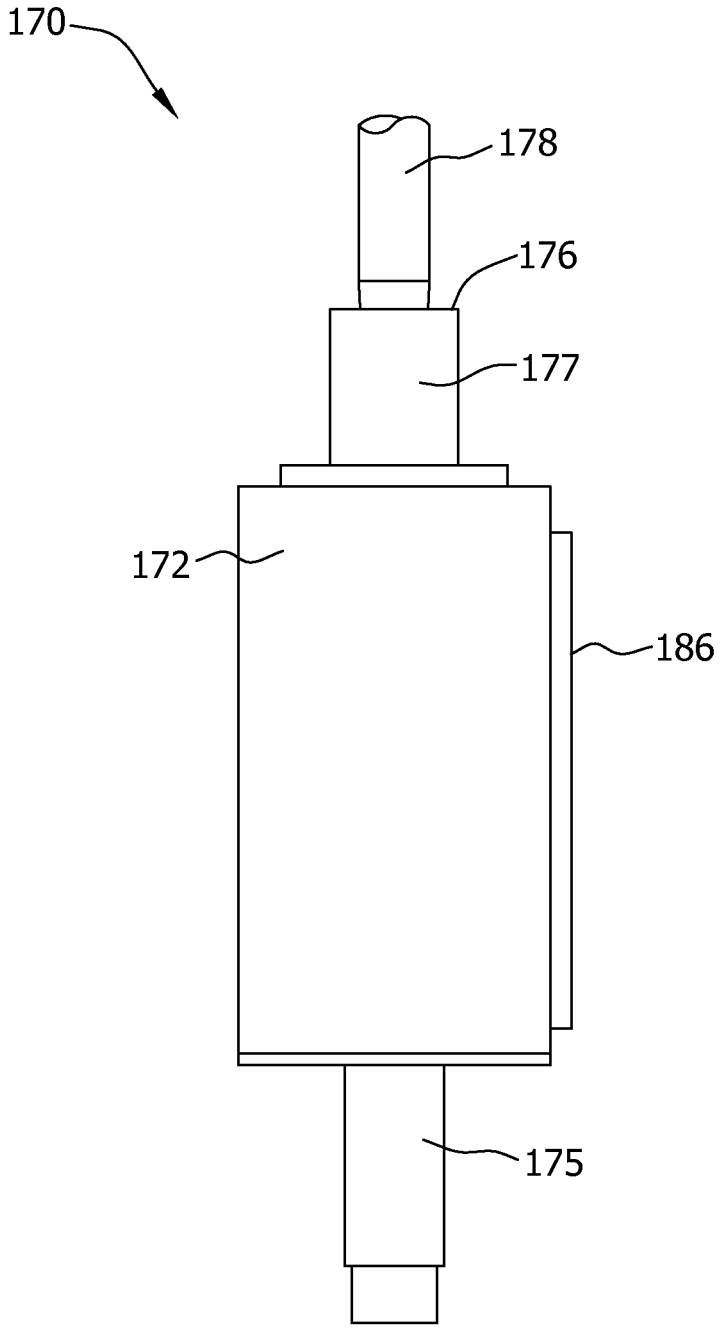
FIG. 18 is a top elevation of the folding roll.
Figure 19:
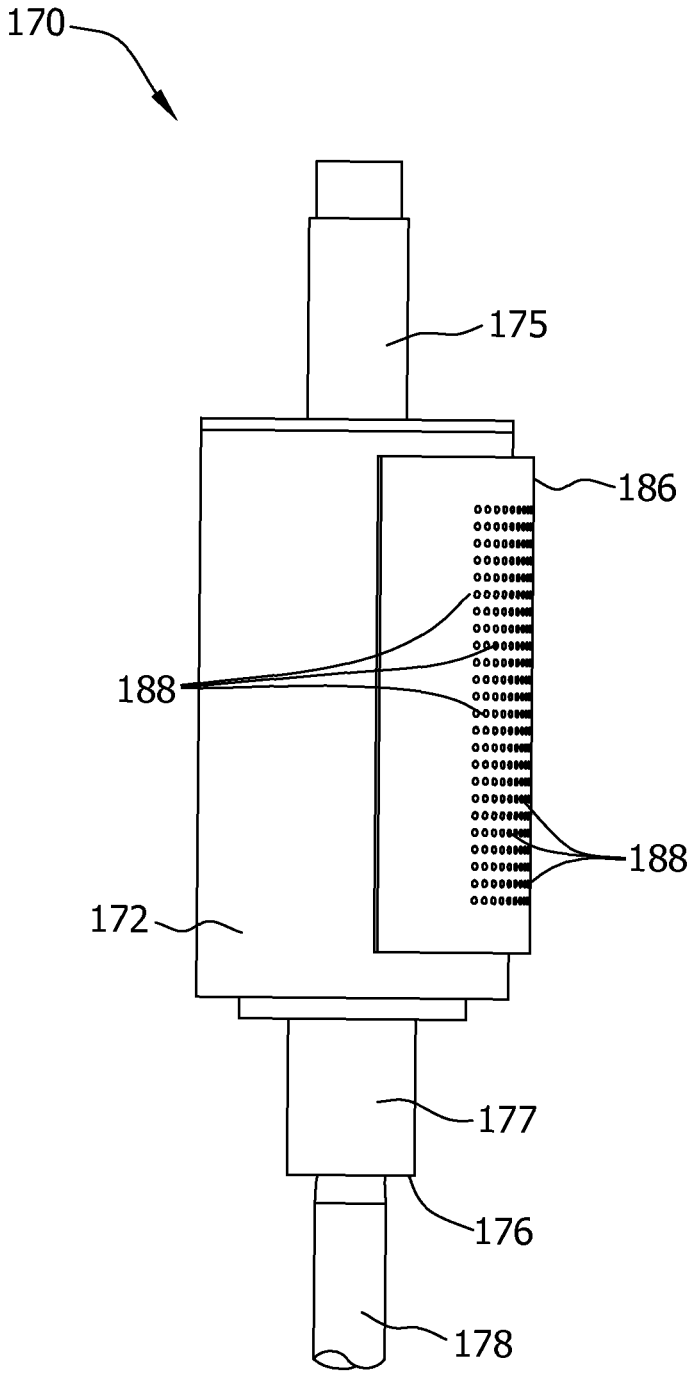
FIG. 19 is a bottom elevation of the folding roll.
Figure 20:
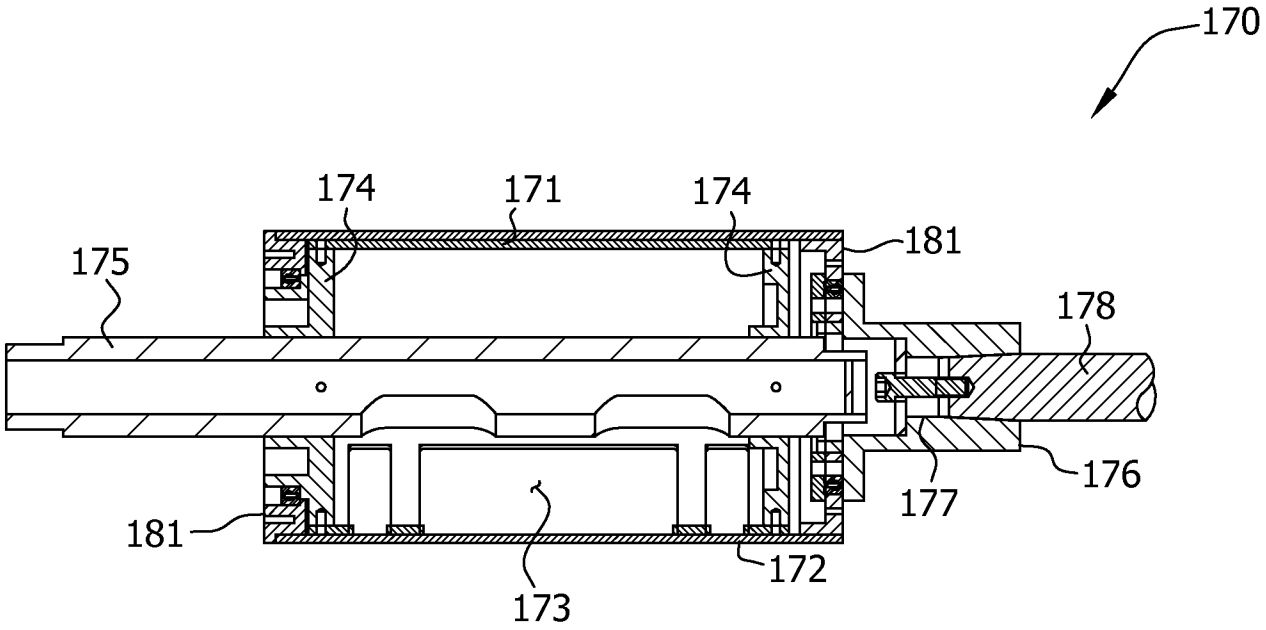
FIG. 20 is a vertical cross-section of the folding roll.

As illustrated in FIGS. 15-22, the folding roll 170 comprises an inner cylinder 171 and an outer cylinder 172 that is rotatable about the inner cylinder. As seen in FIGS. 15-19, the outer cylinder 172 comprises a raised puck 186 adapted to receive the portion of the training pant 500 from the oscillating member 150 and to transfer the portion back to the conveying member 80. The raised puck 186 includes a plurality of circular apertures 188 arranged generally in a rectangle (FIG. 16). It is understood, however, that the raised puck 186 can be flush with the remainder of the outer cylinder 172 (i.e., not raised). It is further understood that the apertures 188 in the puck 186 of the outer cylinder 172 can be arranged differently, that there could be more or fewer apertures than illustrated in the accompanying drawings, and that the apertures can have different shapes and sizes than those illustrated. The outer cylinder 172 is closed by a pair of end plates 181 (FIG. 20).

Figure 21:
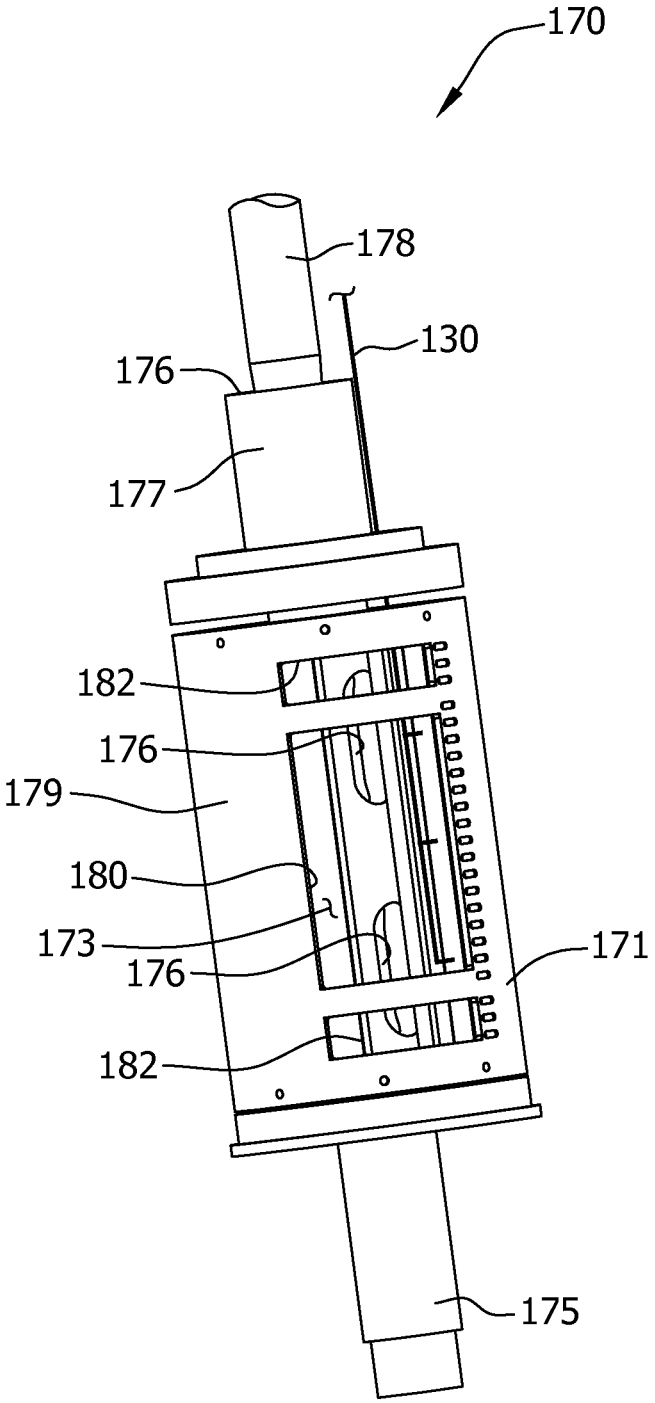
FIGS. 21 and 22 are perspectives of the folding roll with an outer cylinder of the folding roll removed.
Figure 22:
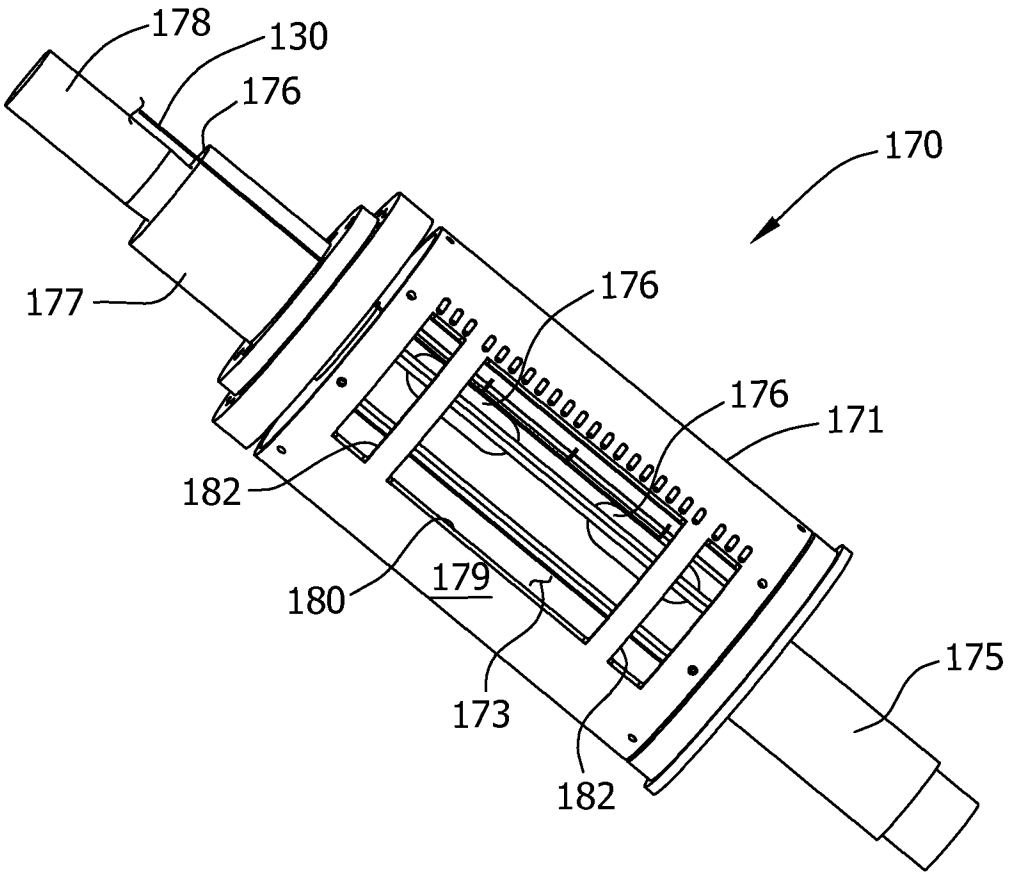

In the illustrated embodiment, the inner cylinder 171 is stationary and defines an interior chamber 173 (FIGS. 20-22). As illustrated in FIGS. 21 and 22, the inner cylinder 171 comprises a wall 179 having a primary rectangular opening 180 and pair of secondary rectangular openings 182 flanking the primary opening. It is understood that the openings 180, 182 in the inner cylinder 171 can have other shapes and configurations than rectangular and that one or both of the secondary openings can be omitted.

A pair of end plates 174 are disposed adjacent the ends of the inner cylinder 171 and closes the interior chamber 173 (FIG. 20). A conduit 175 extends into and is in fluid communication with the interior chamber 173 for allowing a suitable vacuum source (not shown) to apply a vacuum thereto. In the illustrated embodiment, the conduit 175 extends through the interior chamber 173 and has a pair of oval openings 176 that opens within the interior chamber (FIGS. 21 and 22). It is understood that the conduit 175 may extend only partially into the interior chamber and that the openings in the conduit can vary in shape, size and number.

A drive assembly 176 is operatively connected to the outer cylinder 172 for rotating the outer cylinder with respect to the inner cylinder 171. The drive assembly 176 includes a hub 177, a shaft 178 coupled to the hub, and a suitable drive mechanism (not shown) capable of rotating the shaft and hub. In the illustrate embodiment, the drive assembly 176 is capable of rotating the outer cylinder 172 relative to the inner cylinder 171 at variable speeds in a counterclockwise direction. It is understood, however, that the drive assembly 176 can be configured to rotate the outer cylinder 172 in a clockwise direction or in both the counterclockwise and clockwise directions.

Both the oscillating member 150 and the folding roll 170 are described herein as using vacuum to hold the training pant 500 to their respective outer cylinder 152, 172. Thus, both of the illustrated oscillating member 150 and the folding roll 170 can broadly be referred to as a vacuum roll. It is contemplated, however, that other suitable structure (e.g., adhesive, frictional members, nano-fabricated hairs) capable of grasping, controlling, and releasing the training pant 500 can be used instead.

With reference again to FIGS. 1-3, the bump roll 105 is used to assist in the transfer of the portion of the training pants 500 from the conveying member 80 to the oscillating member 150 as described below in more detail. The bump roll 105, as illustrated in the accompanying drawings, is rotatable relative to the conveying member 80 and includes a raised engagement surface 107 that intermittently engages the conveying member 80 as the bump roll rotates. It is understood that the bump roll 105 can have other shapes and sizes and that the engagement surface 107 can be flush with respect to other portions of the bump roll (i.e., not raised). It is also understood that in other embodiments the bump roll 105 can be stationary. It is further understood that in some embodiments of the folding apparatus 100 the bump roll 105 can be omitted.

Figure 23:
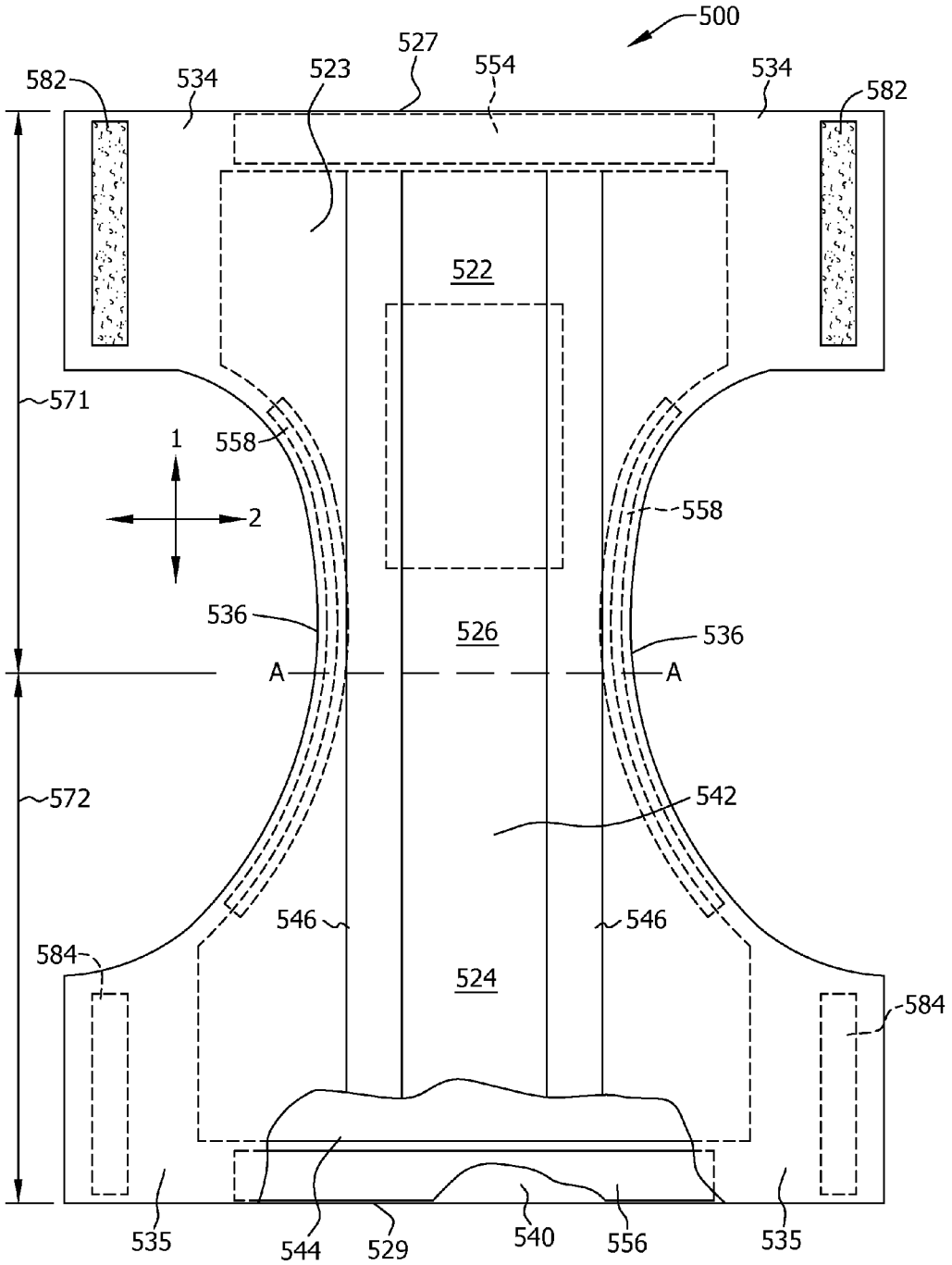
FIG. 23 is a top view of a training pant in a prefolded, laid-flat configuration with portions of the training pant cut away.

As mentioned above, the folding system 50 schematically illustrated in FIG. 1 can be used to fold training pants 500, which are well-known in the art. FIGS. 23-28 illustrate one embodiment of a known training pant 500 that is suitable for being folded by the described folding system 50. The training pant 500 is illustrated in FIG. 23 in its pre-folded, laid-flat configuration. It should be understood that a "pre-folded configuration" is not limited to a training pant having no folds, but rather refers to a training pant entering the folding apparatus 100 (i.e., the training pant has not yet been folded specifically by the folding apparatus). Accordingly, the training pant 500 may or may not comprise additional folds or folded portions prior to entering the folding apparatus 100.

Figure 24:
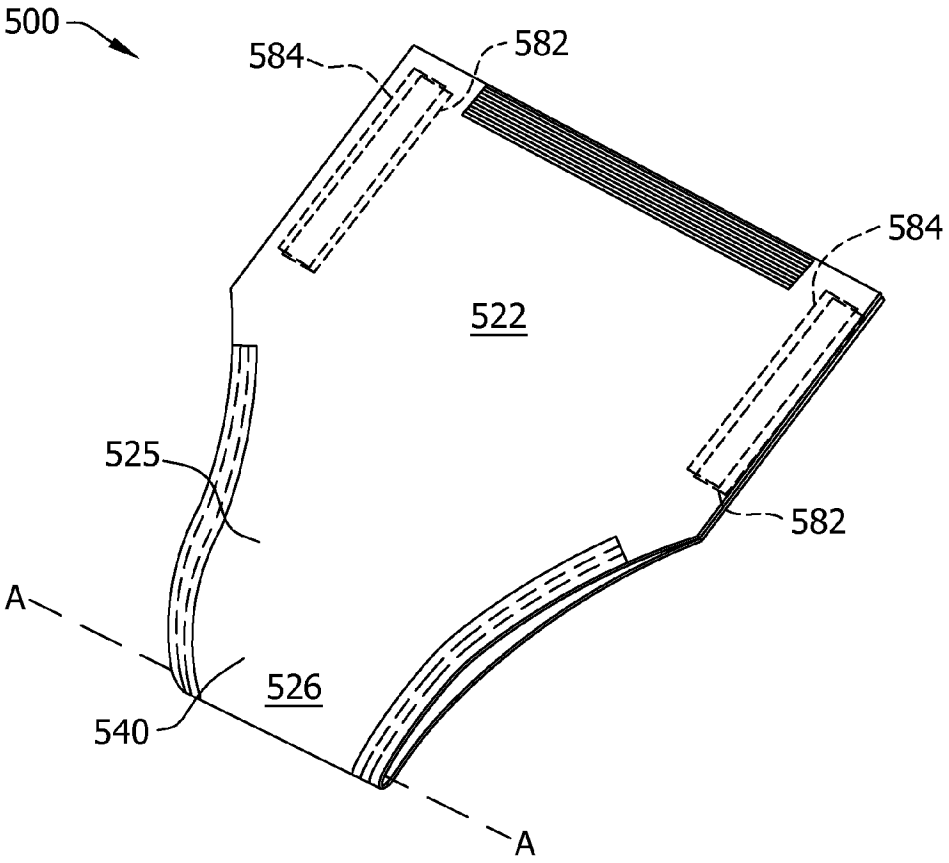
FIG. 24 is a top view of the training pant of FIG. 23 in a folded configuration.
Figure 25:
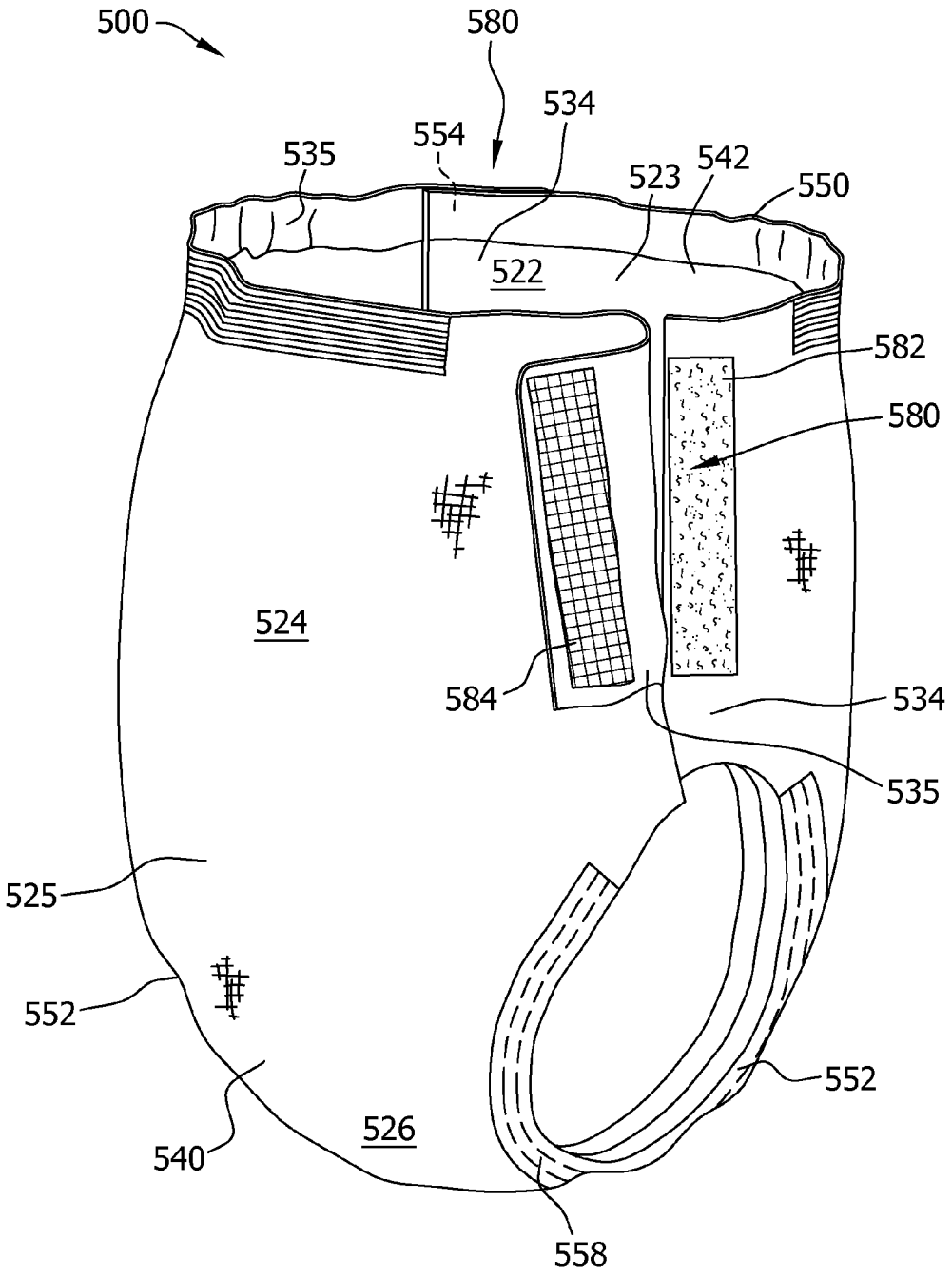
FIG. 25 is a perspective of the training pant in a partially fastened ready-to-use configuration.

FIG. 24 illustrates the training pant 500 in its folded configuration, i.e., after it has been folded by the folding apparatus 100. By "folded configuration" it is meant that the training pant 500 has been folded specifically by the folding apparatus 100. FIG. 25 illustrates the training pant 500 in a partially-fastened, ready-to-use configuration.

As seen in FIG. 23, the training pant 500 has a longitudinal direction 1, a transverse direction 2 that is perpendicular to the longitudinal direction, a leading edge 527, and a trailing edge 529. The training pant 500 defines a front region 522, a back region 524, and a crotch region 526 extending longitudinally between and interconnecting the front region and the back region. The training pant 500 also has an inner surface 523 (i.e., body-facing surface) adapted in use to be disposed toward the wearer, and an outer surface 525 (i.e., garment-facing surface) opposite the inner surface.

The illustrated training pant 500 also includes an outer cover 540, and a liner 542 joined to the outer cover, and an absorbent core 544 disposed between the outer cover and the liner. A pair of containment flaps 546 is secured to the liner 542 and/or the absorbent core 544 for inhibiting generally lateral flow of body exudates. The outer cover 540, the liner 542 and the absorbent core 544 can be made from many different materials known to those skilled in the art. The illustrated training pant 500 further includes a pair of transversely opposed front side panels 534, and a pair of transversely opposed back side panels 535. The side panels 534, 535 can be integrally formed with either the outer cover 540 or the liner 542, or may comprise separate elements.

As seen in FIG. 25, the front and back side panels 534, 535 of the training pant 500 can be selectively connected together by a fastening system 580 to define a three-dimensional configuration having a waist opening 550 and a pair of leg openings 552. The fastening system 580 comprises laterally opposite first fastening components 582 adapted for refasten able engagement to corresponding second fastening components 584. In one embodiment, each of the first fastening components 582 comprises a plurality of engaging elements adapted to repeatedly engage and disengage corresponding engaging elements of the second fastening components 584 to releasable secure the training pant 500 in its three-dimensional configuration.

The fastening components 582, 584 can comprise any refasten able fasteners suitable for absorbent articles, such as adhesive fasteners, cohesive fasteners, mechanical fasteners, or the like. In one particular embodiment, the fastening components 582, 584 comprise complementary mechanical fastening elements. Suitable mechanical fastening elements can be provided by interlocking geometric shaped materials, such as hooks, loops, bulbs, mushrooms, arrowheads, balls on stems, male and female mating components, buckles, snaps, or the like.

In the illustrated embodiment, the first fastening components 582 comprise loop fasteners and the second fastening components 584 comprise complementary hook fasteners. Alternatively, the first fastening components 582 may comprise hook fasteners and the second fastening components 584 may comprise complementary loop fasteners. In another embodiment, the fastening components 582, 584 can comprise interlocking similar surface fasteners, or adhesive and cohesive fastening elements such as an adhesive fastener and an adhesive-receptive landing zone or the like. Although the training pant 500 illustrated in FIG. 25 show the back side panels 535 overlapping the front side panels 534 upon connection thereto, which is conventional, the training pant can also be configured so that the front side panels overlap the back side panels when connected.

The illustrated training pant 500 further includes a front waist elastic member 554, a rear waist elastic member 556, and leg elastic members 558, as are known to those skilled in the art. The front and rear waist elastic members 554, 556 can be joined to the outer cover 540 and/or liner 542 adjacent the leading edge 527 and the trailing edge 529, respectively, and can extend the full length of or part of the length of the edges. The leg elastic members 558 can be joined to the outer cover 540 and/or liner 542 along transversely opposing leg opening side edges 536 and positioned in the crotch region 526 of the training pant 500.

The elastic members 554, 556, 558 can be formed of any suitable elastic material. As is well known to those skilled in the art, suitable elastic materials include sheets, strands or ribbons of natural rubber, synthetic rubber, or thermoplastic elastomeric polymers. The elastic materials can be stretched and bonded to a substrate, bonded to a gathered substrate, or bonded to a substrate and then elasticized or shrunk, for example with the application of heat, such that elastic constrictive forces are imparted to the substrate. One non-limiting example of a suitable elastic material includes dry-spun coalesced multifilament spandex elastomeric threads sold under the trade name LYCRA, available from In vista, having a place of business located in Wichita, Kans., U.S.A.

FIG. 24 illustrates the training pant 500 in its folded configuration wherein it has been folded about a transverse fold axis A-A so that a first portion 571 of the training pant is in a superimposed relation with a second portion 572 of the training pant. The first and second portions 571, 572 of the training pant are illustrated in FIG. 23. In the illustrated embodiment, the inner surface 523 of the first portion 571 is in a facing relation with the inner surface of the second portion 572. In addition, the transverse fold axis A-A is shown in the approximate longitudinal center of the refolded-training pant 500, and the leading edge 527 and the trailing edge 529 of the folded training pant are longitudinally aligned. It is understood that the transverse fold axis A-A can be positioned anywhere between the leading edge 527 and the trailing edge 529 as may be desired, which can result in a longitudinal offset of the leading edge and the trailing edge (particularly as it relates to other products). Moreover, the transverse fold axis A-A need not be perpendicular to the longitudinal direction 1, but rather may be skewed at an angle from the transverse direction 2, if desired. It can also be seen in the illustrated embodiment that the first fastening component 582 and the second fastening component 584 are accurately aligned with one another.

Figure 26:
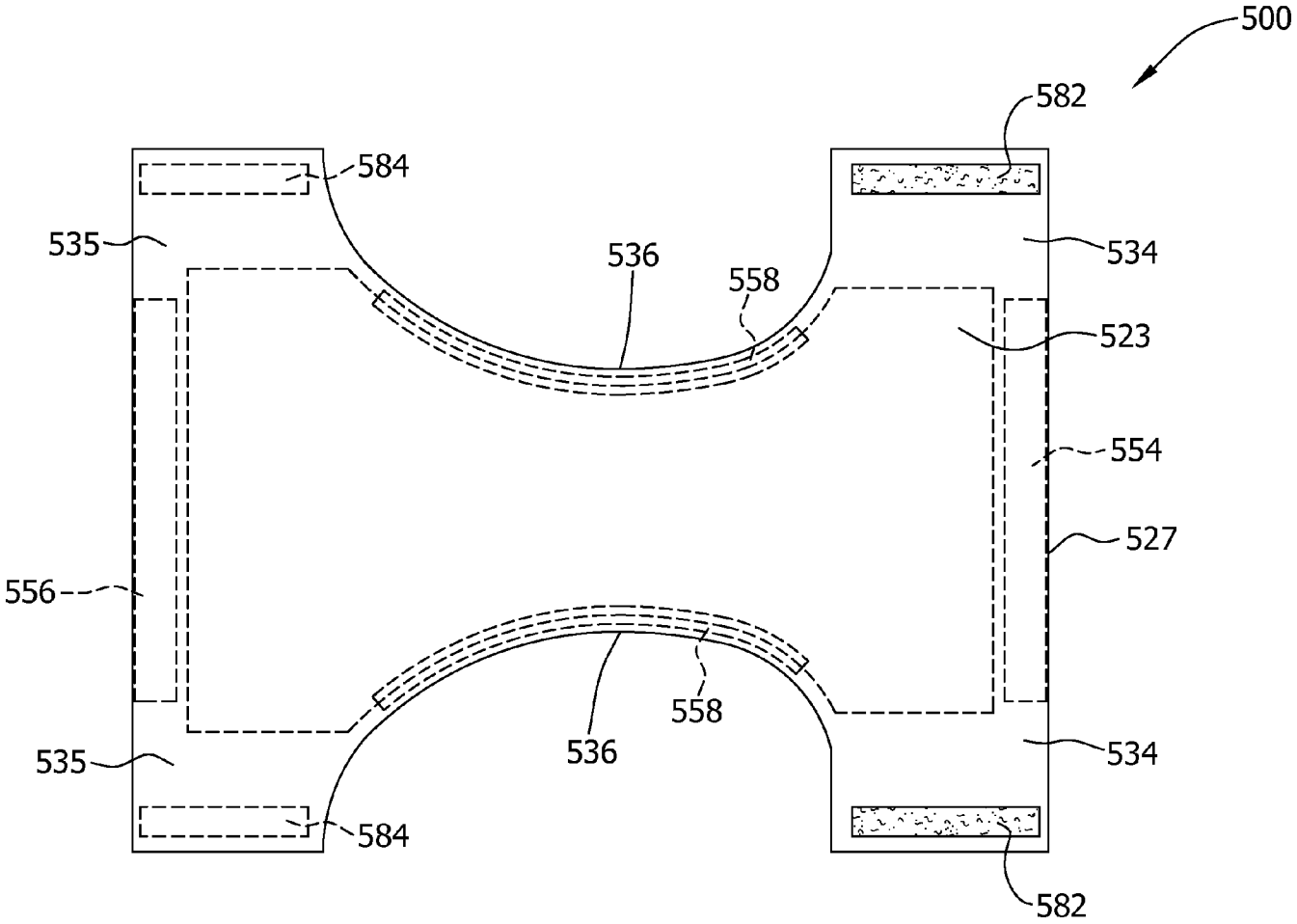
FIG. 26 is a top view of the training pant having front and back side panels.
Figure 27:
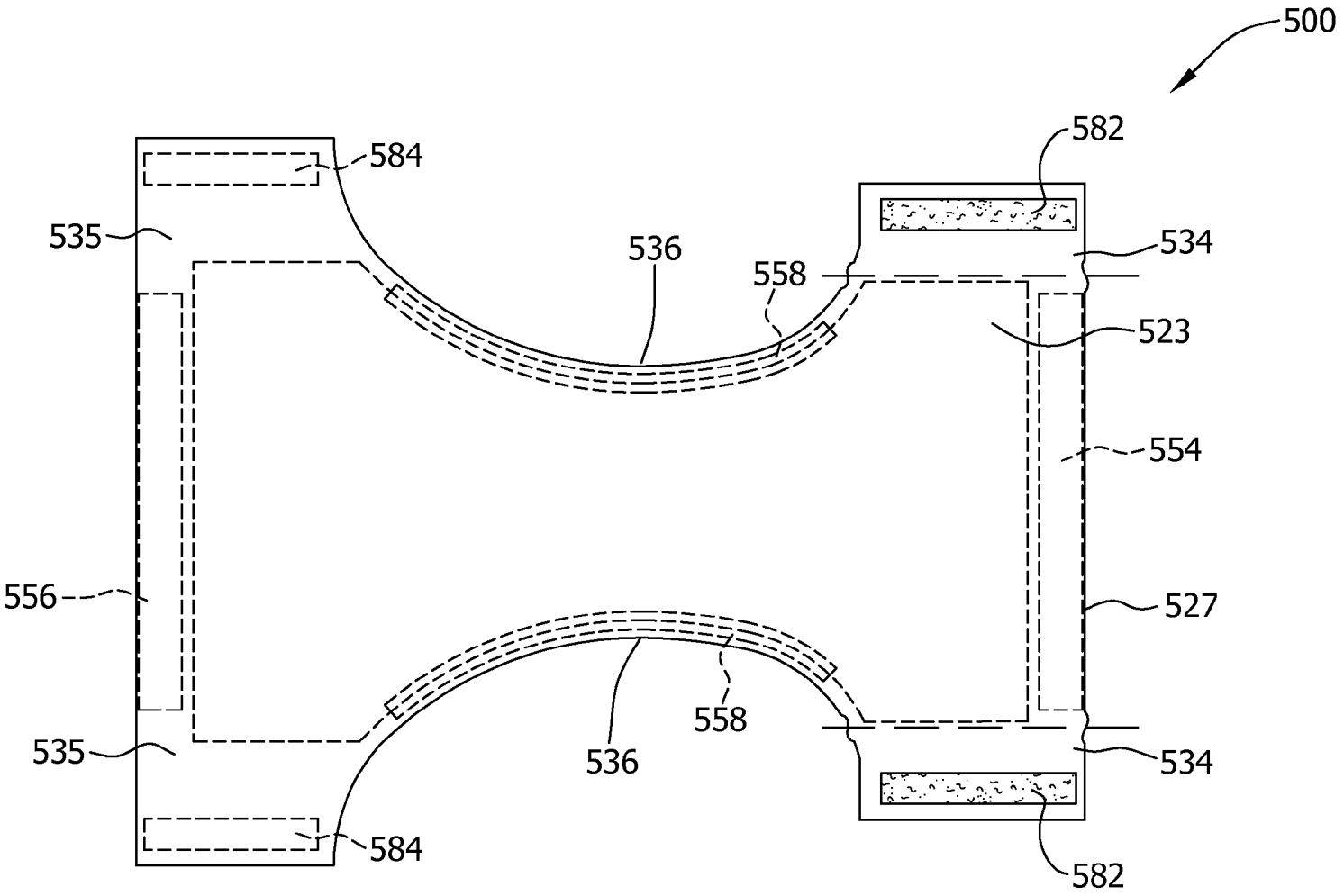
FIG. 27 is a top view similar to FIG. 26 but with the front side panels of the training pant being scrunched.

In this embodiment and as illustrated in FIG. 1, a discrete training pant 500 (one of the plurality of training pants passing through the folding system 50) is delivered by the conveying member 80 at a constant conveying speed to one of the oscillating members 150. The training pant 500 is delivered to the oscillating member 150 with its front side panels 534 scrunched and each of its second fastening components 584 inverted (i.e., flipped approximately 180°). FIGS. 26 and 27 illustrate the training pant 500 with its front side panels 534 in their pre-scrunched and post-scrunched configurations, respectively. As seen in FIG. 27, each of the front side panels 534 is scrunched so that the first fastening components 582 are moved closer together as compared to the pre-scrunched configuration. It is contemplated that other portions of the front region 522 of the training pant 500 (i.e., portions other than the front side panels) can be scrunched to bring the first fastening components 582 closer together.

Figure 28:
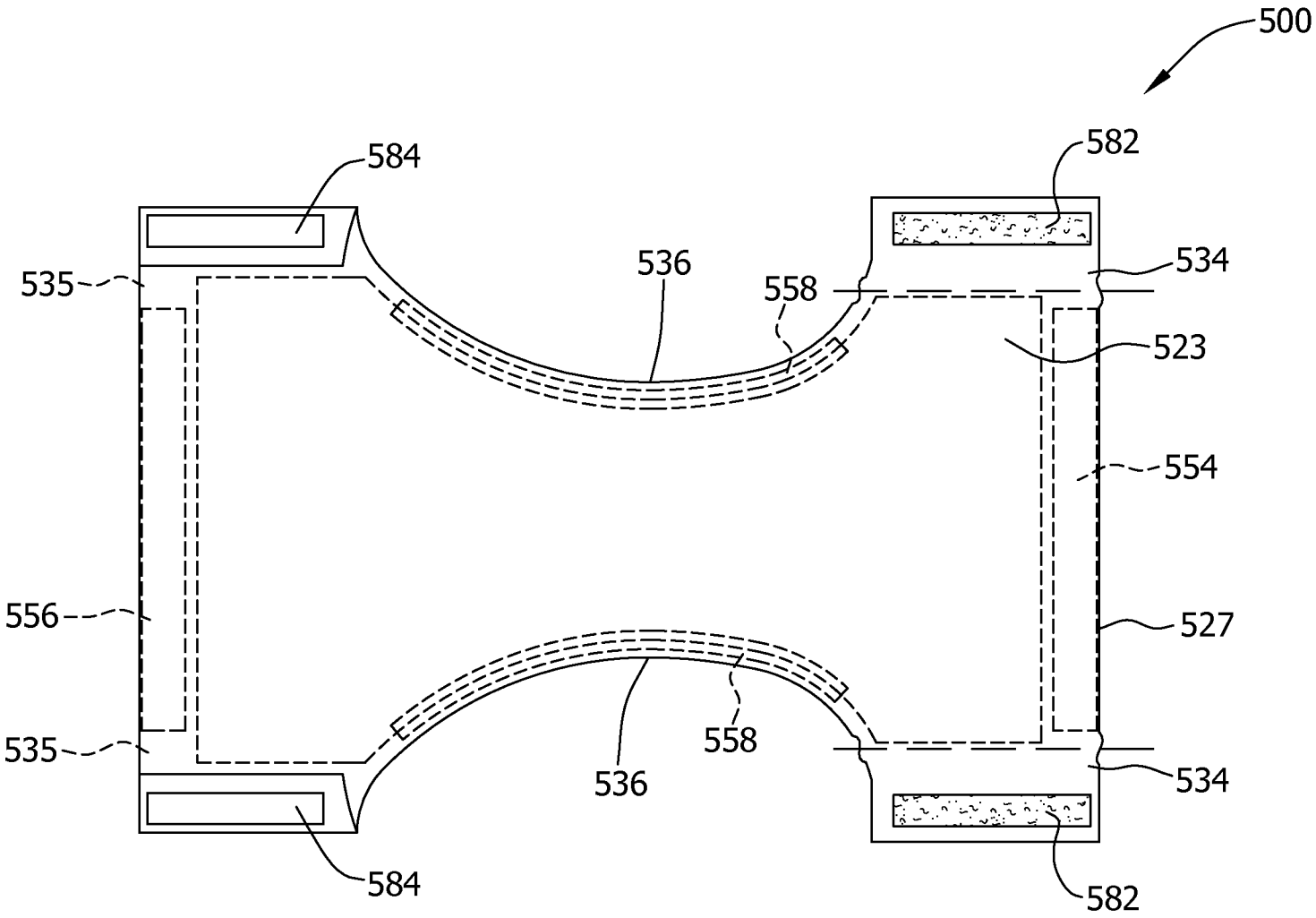
FIG. 28 is a top view similar to FIG. 27 but with portions of the back side panels being inverted.

The training pant 500 is illustrated in FIG. 28 with its second fastening components 584, which are located on respective back side panels 535, inverted and its front side panels 534 scrunched. As seen therein, both the first and second fastening components 582, 584 are now facing in the same direction. In addition, each of the first fastening components 582 is longitudinally aligned with a respective one of the second fastening components 584. As mentioned above, the training pant 500 is delivered to the folding apparatus 100 and, more specifically, to the oscillating member 150 with its front side panels 534 scrunched and each of its second fastening components 584 inverted.

In the illustrated embodiment, half of the training pants 500 are delivered to each of the oscillating members 150. Since both of the folding apparatus 100 are the same, the operation of only one of them will be described herein. The training pant 500 is delivered to the oscillating member 150 by the conveying member 80 with its outer cover 540 facing downward (i.e., toward the conveying member) and its first and second fastening components 582, 584 facing upward (i.e., away from the conveying member). The oscillating member 150 is aligned with the conveying member 80 such that the narrower portion of slots 163 (the portions of the slots having the narrower width W2) in the inner cylinder 151 of the oscillating member begins at approximately the tangent point with the conveying member.

Figure 29:
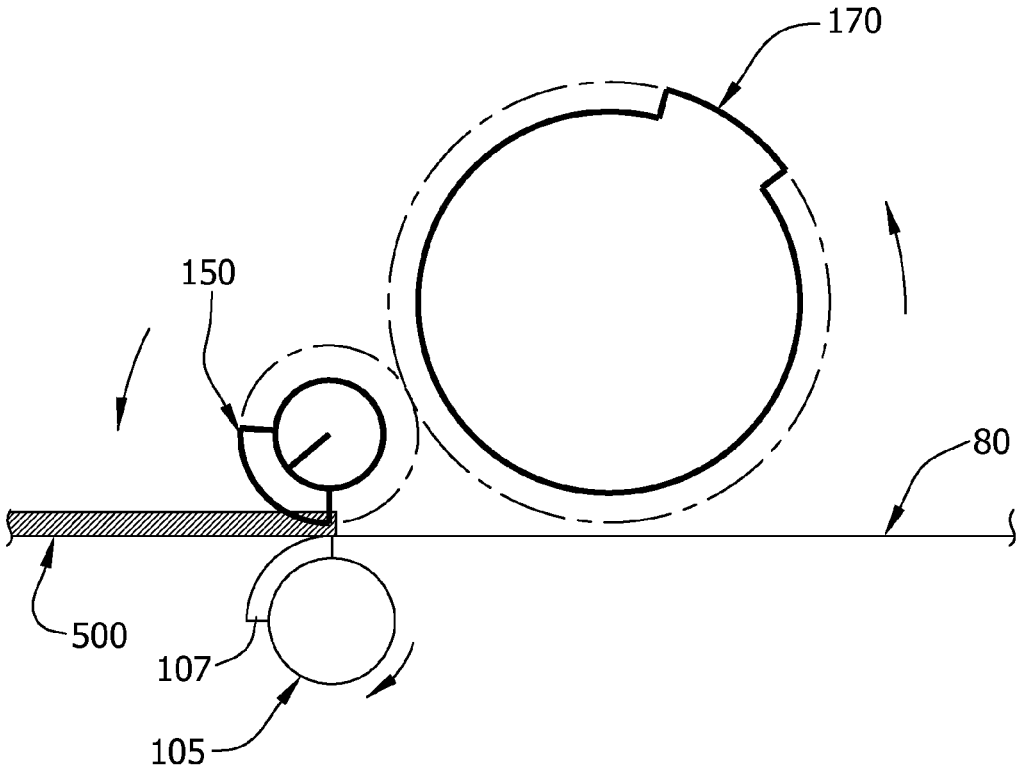
FIG. 29 is a schematic of the folding apparatus with the training pant entering the folding apparatus in its refolded configuration via a conveying member and being grasped by the oscillating member.

When the leading edge 527 of the first portion 571 of the training pant 500 reaches the oscillating member 150, the liner 542 of the training pants is aligned with and grasped by the puck 164 of the outer cylinder 152 of the oscillating member (FIG. 29). More specifically, the puck 164 of the oscillating member 150 contacts the liner 542 in the first portion 571 of the training pant 500 at a first nip defined by the puck of the oscillating member and the conveying member 80. At this point, the training pant 500 is subject to the vacuum of the oscillating member 150 through the apertures 169 in the puck 164 as a result of the apertures being aligned with the narrow portions of the slots 163 in the inner cylinder 151. Particularly, each of the first fastening components 582 and the front waist elastic member 554 of the training pant 500 is grasped by the puck 164 because of the vacuum being applied thereto through the apertures 169 in the puck.

As seen in FIG. 29, the engagement surface 107 of the bump roll 105 contacts the lower surface of the conveying member 80 and inhibits the conveying member 80 from moving away (i.e., downward as viewed in FIG. 29) from the oscillating member 150 when the puck 164 of the oscillating member is in the process of grasping the first portion 571 of the training pant 500 from the conveying member at the first nip. It is contemplated that the engagement surface 107 of the bump roll 105 can be used to move the conveying member 80 toward (i.e., upward as viewed in FIG. 29) the oscillating member 150.

In the illustrated embodiment, the engagement surface 107 of the bump roll 105 and the puck 164 of the oscillating member 150 have approximately the same size. As a result, the bump roll 105 is in contact with the conveying member 80 throughout the transfer of the first portion 571 of the training pant 500 from the conveying member to the puck 164 of the oscillating member 150. It is understood, however, that engagement surface 107 of the bump roll 105 can be larger or smaller than the puck 164 of the oscillating member 150.

Figure 30:
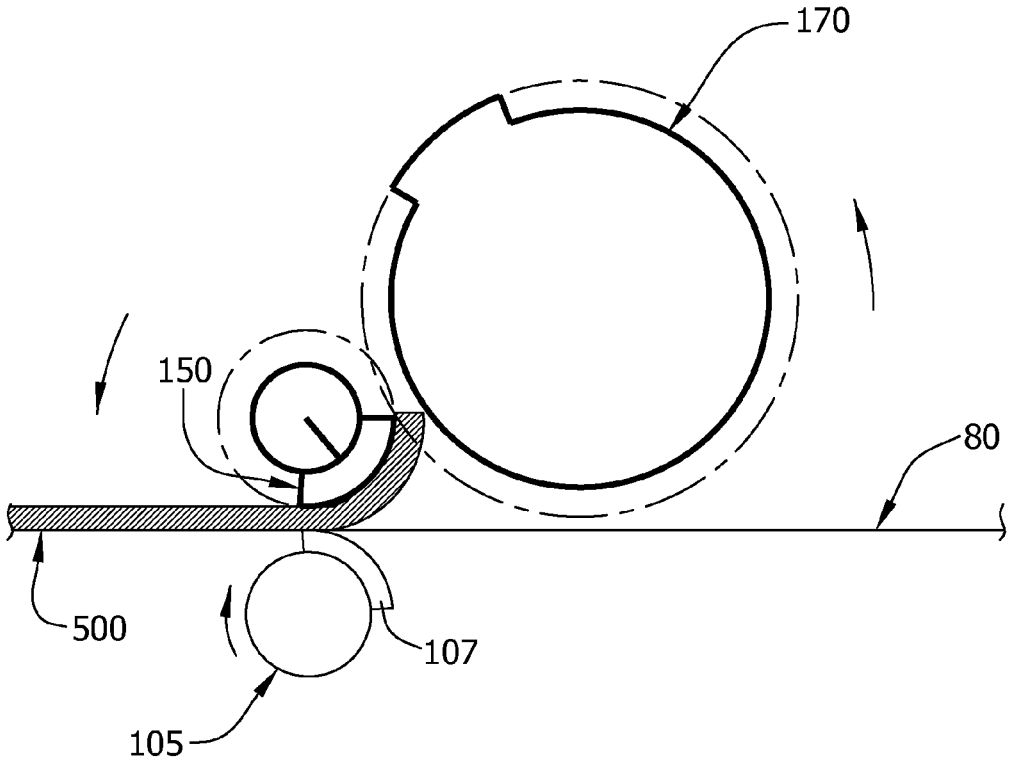
FIG. 30 is a schematic of the folding apparatus with a portion of the training pant being lifted off of the conveying member by the oscillating member.

As the bump roll 105 continues to rotate, the engagement surface 107 moves out of contact with the lower surface of the conveying member 80 (FIG. 30). In the illustrated embodiment, the bump roll 105 rotates in a clockwise direction and at a constant speed. It is contemplated, however, that the bump roll 105 can be rotated at variable speeds and in a counterclockwise direction (e.g., in an embodiment of the folding apparatus 100 wherein the oscillating member 150 is rotating in clockwise direction when it grasps the first portion 571 of the training pant 500).

With reference still to FIG. 30, as the oscillating member 150 rotates away from the conveying member 80, the leading edge 527 of the training pant 500 is lifted off of the conveying member and transferred to the puck 164 of the oscillating member 150. As the remainder of the first portion 571 of the training pant 500 is delivered to the oscillating member 150 by the conveying member 80, it is aligned with and grasped by the oscillating member in substantially the same manner as the leading edge 527. The second portion 572 remains on the conveying member 80.

Figure 31:
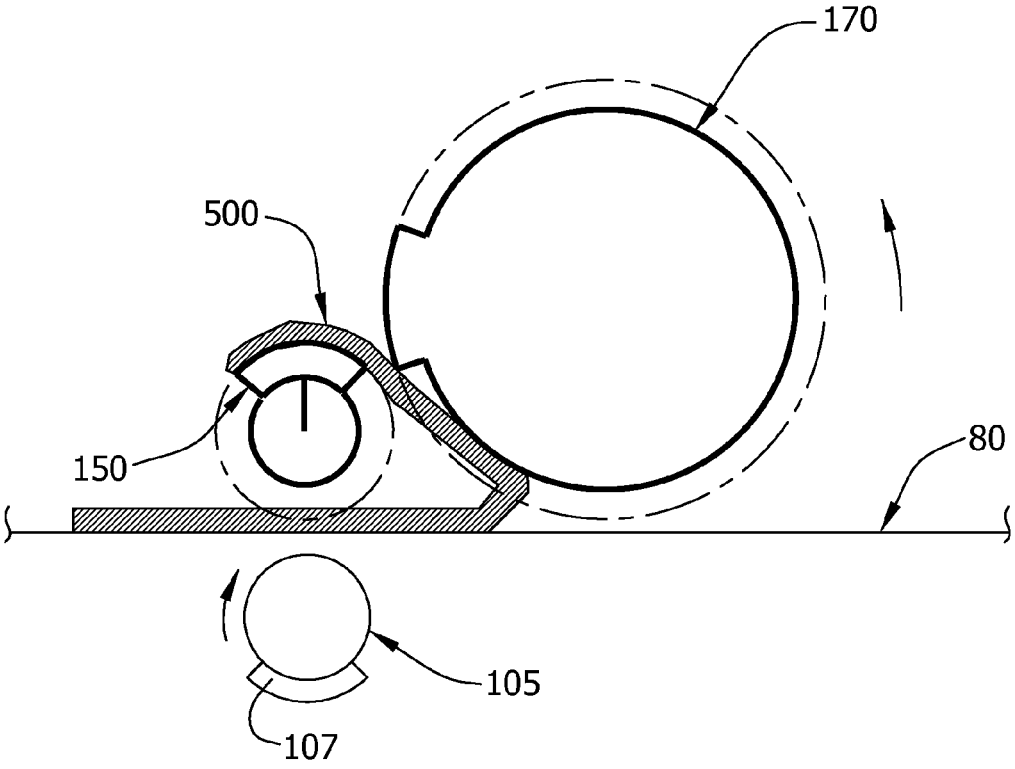
FIG. 31 is a schematic of the folding apparatus with the training pant being folded by the oscillating member and having the portion thereof held by the oscillating member, the oscillating member and the folding roll rotating in the same direction.

The first portion 571 of the training pant 500 is transferred to the puck 164 of the outer cylinder 152 of the oscillating member 150 while the outer cylinder (and thereby the puck) is being rotated relative to the conveying member 80 by the drive assembly 157 of the oscillating member. As seen in FIGS. 29-31, the outer cylinder 152 of the oscillating member 150 is moving in the counterclockwise direction (broadly, a first direction). In addition, the outer cylinder 152 of the oscillating member 150 is rotating at approximately the same surface speed as the training pant 500 as it moves linearly along the conveying member 80 when the first portion 571 of the training pant 500 is transferred from the conveying member to the oscillating member 150.

Once the first portion 571 of the training pant 500 is transferred from the conveying member 80 to the oscillating member 150 (or shortly thereafter), the outer cylinder 152 of the oscillating member begins to slow down. That is, the drive assembly 157 of the oscillating member 150, which is variable, reduces the surface speed at which the outer cylinder 152 of the oscillating member rotates relative to the conveying member 80. Once the outer cylinder 152 of the oscillating member 150 rotates a predetermined amount in the counterclockwise direction, the outer cylinder stops and rotates in the opposite direction (i.e., the clockwise direction and broadly, a "second direction"). In the illustrated embodiment, the outer cylinder 152 of the oscillating member 150 moves in a generally pendulum manner through about 270 degrees. In other words, the outer cylinder 152 of the oscillating member 150 rotates in a counterclockwise direction through about three-fourths of a rotation, stops, and then rotates back in a clockwise direction to its original position.

Because of the slowing, stopping, and change in rotational direction of the outer cylinder 152 of the oscillating member 150 relative to the conveying member 80, which is moving at a constant surface speed, the training pant 500 begin to fold (FIG. 31).

With the outer cylinder 152 of the oscillating member 150 stopped (FIG. 31) or beginning to rotate in the clockwise direction (FIG. 32), the actuator 168 of the oscillating member 150 is actuated by applying the preset input current to the actuator thereby causing the inner cylinder to translate relative to the outer cylinder 152 as illustrated in FIGS. 13 and 14. Since this occurs when the apertures 169 in the puck 164 of the oscillating member 150 are aligned with wider portions of the slots 163 in the slotted segment 162 (i.e., the portions of the slots 163 having the wider width W1), the first portion 571 of the training pant 500 remains securely held to the puck 164 by the vacuum. As seen in FIG. 13, the apertures 169 in the puck 164 remain in fluid communication with the vacuum being applied to the interior chamber 153 through the wider portions of the slots 163 by the vacuum source.

As the outer cylinder 152 of the oscillating member 150 rotates in the clockwise direction (FIG. 32), the apertures 169 in the puck 164 move out of alignment with the wider portions of the slots 163 and adjacent the narrower portions (FIG. 14). As a result of the apertures 169 in the puck 164 not being aligned with the narrow portions of the slots 163, the vacuum being applied to the interior chamber 153 by the vacuum source is blocked by the inner cylinder and thereby inhibited from reaching the first portion 571 of the training pant 500 via the apertures 169 in the puck 164. In other words, the first portion 571 of the training pant 500 is released from the vacuum of the oscillating member 150.

As mentioned above, the outer cylinder 152 of the oscillating member 150 rotates in a counterclockwise direction through about three-fourths of a rotation, stops, and then rotates back in a clockwise direction to its original position. The actuator 168 of the illustrated embodiment is configured to be in its normal position when the outer cylinder 152 is rotating in the counterclockwise direction, and in its actuated position when the outer cylinder is rotating in its clockwise direction. As a result, the inner cylinder 151 is in the first position when the outer cylinder 152 is rotating counterclockwise and the second position when the outer cylinder is rotating in the clockwise direction. It is understood that the position of the inner cylinder 151 can be changed (i.e., the actuator 168 actuated or de-actuated) when the outer cylinder 152 is at a stopped position or while it is rotating.

Figure 32:
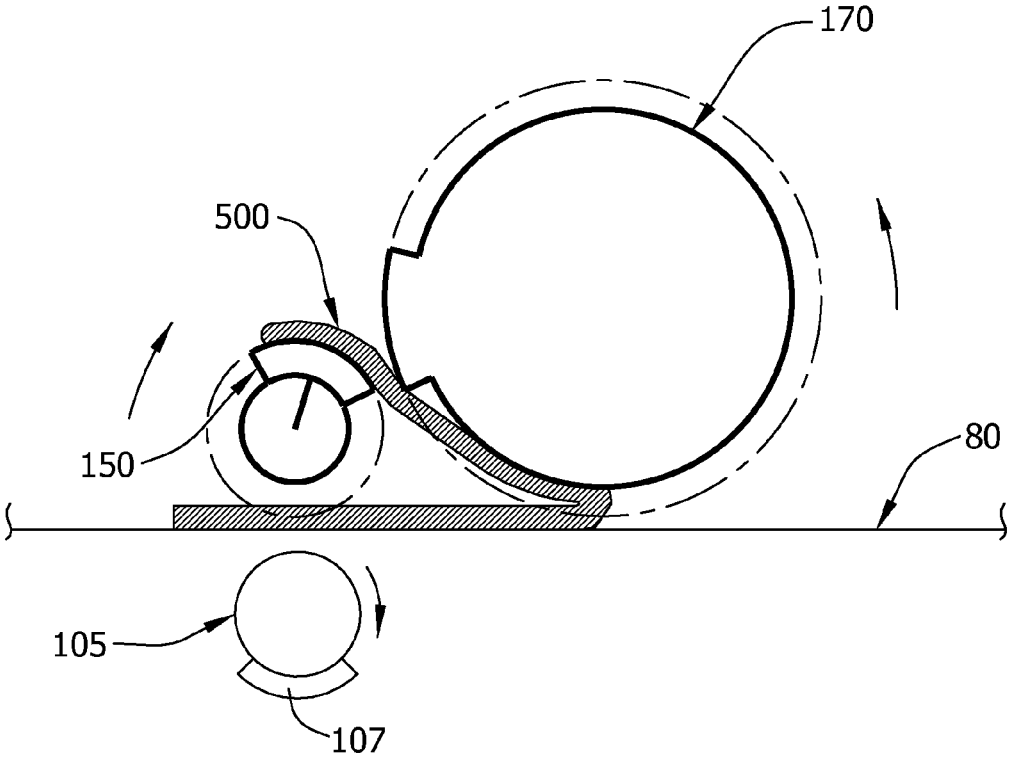
FIG. 32 is a schematic of the folding apparatus with the training pant being folded by the oscillating member and having the portion thereof held by the oscillating member, the oscillating member and the folding roll rotating in opposite directions.

With the outer cylinder 152 of the oscillating member 150 rotating in the clockwise direction, the first portion 571 of the training pant 500 is contacted by the puck 186 of the outer cylinder 172 of the folding roll 170 at a second nip defined by the oscillating member and the folding roll (FIG. 32). The outer cylinder 172 of the folding roll 170 is rotating at generally the same surface speed as the outer cylinder 152 of the oscillating member 150 but in the opposite direction (i.e., counterclockwise). The rotational surface speed of the outer cylinders 152, 172 of the oscillating member 150 and the folding roll 170 at this point in the folding process are slower than the surface speed of the conveying member 80. As a result, the second portion 572 of the training pant 500 is moving faster than the first portion 571.

Figure 33:
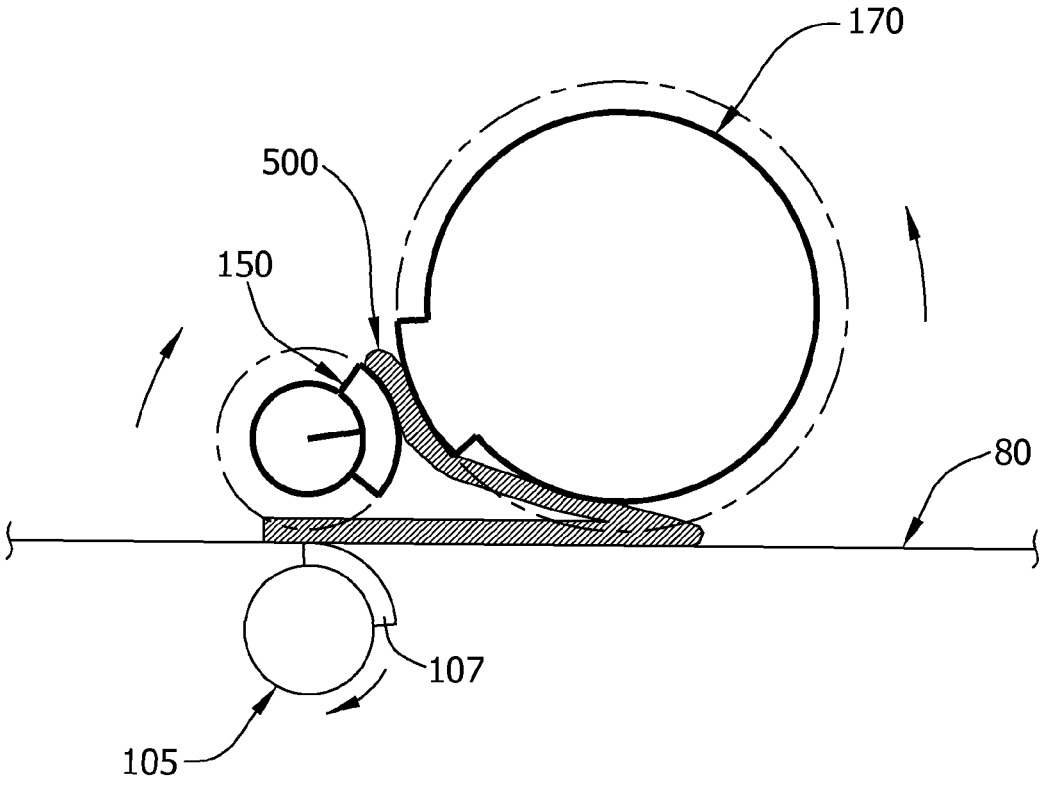
FIG. 33 is a schematic of the folding apparatus with the training pant being transferred from the oscillating member to the folding roll.

Because the vacuum being applied by the oscillating member 150 to the first fastening components 582 and front waist elastic member 554 of the training pant 500 is blocked by the inner cylinder 151, the first portion 571 of the training pant transfers from the puck 164 of the oscillating member to the puck 186 of the outer cylinder 172 of the folding roll 170 (FIG. 33). The primary and secondary openings 180, 182 in the inner cylinder 171 of the folding roll 170 are generally aligned with the apertures 188 in the puck 186 of the outer cylinder 172 of the folding roll thereby subjecting the first portion of the training pant 500 to the vacuum being applied to the interior chamber 173 of the inner cylinder. As a result, the first portion 571 of the training pant 500 transfers to the puck 186 of the outer cylinder 172 of the folding roll 170 at the second nip defined by the puck of the outer cylinder of the folding roll and the puck 164 of the outer cylinder 152 of the oscillating member 150 (FIG. 33).

Once the first portion 571 of the training pant 500 is transferred from the oscillating member 150 to the folding roll 170, the rotational surface speed of the outer cylinder 172 of the folding roll 170 is increased by its drive assembly 176 to generally match the rotational surface speed of the conveying member 80.

Figure 34:
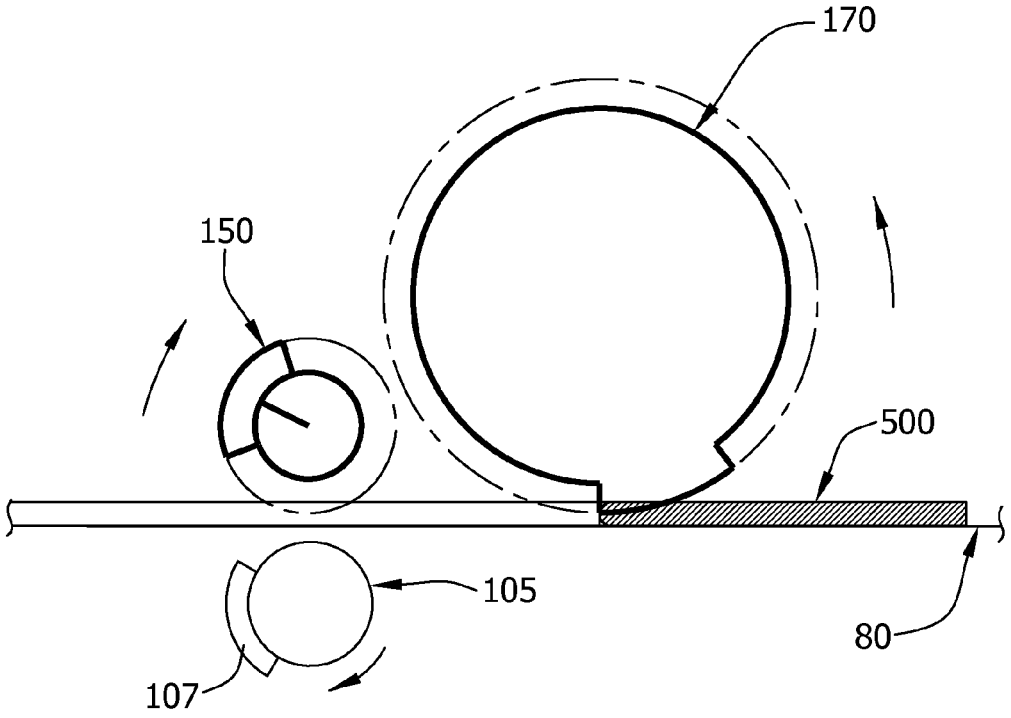
FIG. 34 is a schematic of the folding apparatus with the training pant in its folded configuration and being transferred from the folding roll to the conveying member.

The first portion 571 of the training pant 500 is brought into engagement with the conveying member 80 at a third nip defined between the folding roll 170 and the conveying member such that the first portion 571 of the training pant is in overlying relationship with the second portion 572 (FIG. 34). In addition, each of the first fastening components 582 are engaged to a respective one of the second fastening components 584.

The primary and secondary openings 180, 182 in the inner cylinder 171 of folding roll 170 terminate adjacent the third nip. As a result, the vacuum holding the first portion 571 of the training pant 500 to the puck 186 of the folding roll 170 is blocked from contact therewith. As a result, the first portion 571 of the training pant 500 is transferred back to the conveying member 80 and the training pant is arranged in its folded configuration. In addition, the relative movement between the folding roll 170 and conveying member 80 applies both a compressive force and a shear force to the first and second fastening components 582, 584 thereby securely engaging the first and second fastening components together.

The training pant 500, which is in its folded configuration and has its first and second fastening components 582, 584 engaged, is then transferred by the conveying member 80 away from the other components of the folding apparatus 100.

In one suitable embodiment, training pants 500 can be folded at high line speeds (i.e., rates of 400 products per minute (ppm) or greater, such as 400 ppm to 4000 ppm, or 600 ppm to 3000 ppm, or 900 ppm to 1500 ppm). In the embodiment illustrated in FIG. 1, for example, training pants 500 can be folded at a rate of approximately 1000 ppm.

Each of the illustrated folding apparatus 100 is capable of folding training pants at a rate of approximately 500 ppm. Thus, in another suitable embodiment having only one folding apparatus, the training pants 500 can be manufactured at high line speeds (i.e., 500 ppm). It is understood, that the line speeds of the illustrated manufacturing system 50 can be increased beyond 1000 ppm by adding additional folding apparatus 100 (e.g., three folding apparatus would allow line speeds of up to 1500 ppm, four folding apparatus would allow line speeds of up to 2000 ppm).

Table 1, provided below, provides examples of potential sizes and velocities suitable for the oscillating member 150 and the folding roll 170 of the folding apparatus 100. More specifically, Table 1 provides three suitable radii and velocities for the oscillating member 150 and the folding roll 170 of the folding apparatus 100. In addition, Table 1 provides suitable lengths for the puck 164 of the oscillating member 150.

TABLE 1

| | | | | |
|---|---|---|---|---|
| $V_p$ | 546.10 | 520.70 | 469.90 | mm/rep |
| $V_f$ | 290.54 | 277.03 | 250.00 | mm/rep |
| $L_{puck}$ | 116.2 | 110.81 | 100.00 | mm |
| R_1 | 58.11 | 55.41 | 50.00 | mm |
| R_2 | 151.08 | 144.05 | 130.00 | mm |

$V_p$ - Velocity of the oscillating member 150.
$V_f$ - Velocity of the folding roll 170.
$L_{puck}$ - Length of the puck 164.
R_2 - Radius of the oscillating member 150.
R_3 - Radius of the folding roll 170.

Figure 35:
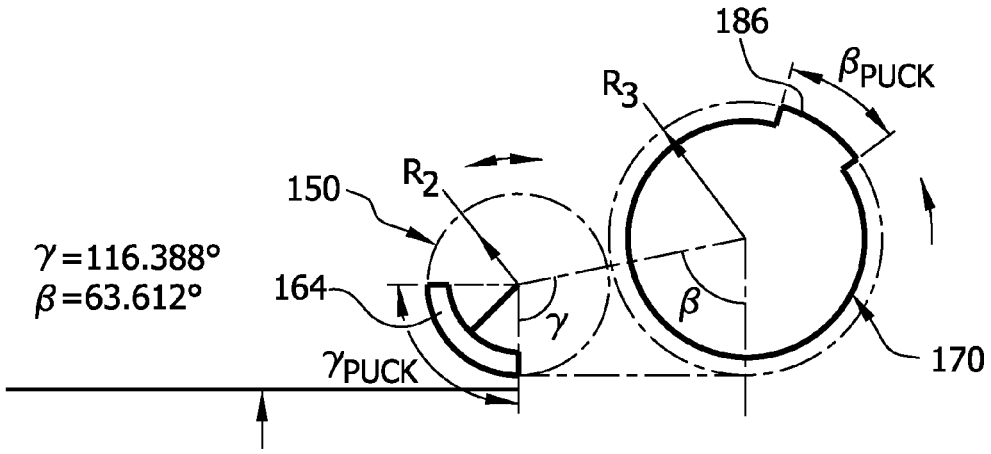
FIGS. 35 and 36 are schematics illustrating suitable relative positions the oscillating roll and folding roll.
Figure 36:
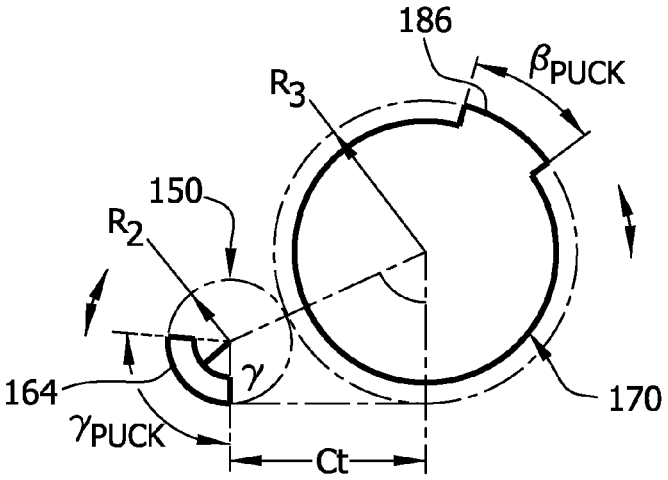

Equations for calculating suitable relative positions of the oscillating roll 150 and folding roll 170 are provided below and illustrated in FIGS. 35 and 36. As seen in FIG. 35, an arc of travel of the folding roll 170 corresponds to an internal angle β. In one suitable embodiment, the radius of the oscillating member 150 and folding roll 170 are selected so that the internal angle β is less than about 70 degrees. Keeping the internal angle β less than about 70 degrees has been found to yield suitable velocity profiles.

Given $R_2$ and $R_3$, the center angles α,β can be computed using the following equations. See FIGS. 35 and 36.

$$\gamma = \frac{\pi}{2} + A\sin\left(\frac{R_3 - R_2}{R_3 + R_2}\right) \tag{1}$$

$$\beta = \frac{\pi}{2} - A\sin\left(\frac{R_3 - R_2}{R_3 + R_2}\right) \tag{2}$$

The horizontal center distance Ct (FIG. 36) between rolls:

$$Ct=\sqrt{(R_2+R_3)^2-(R_3-R_2)^2} \tag{3}$$

Equations of Constraint

Figure 37:
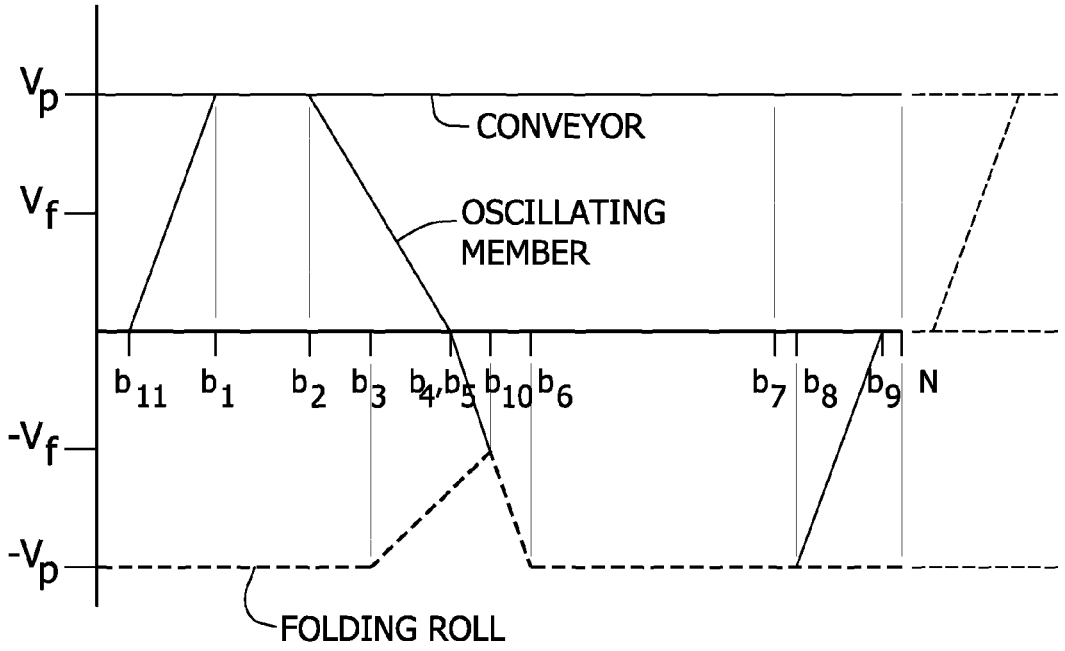
FIG. 37 graphically illustrates eleven constraints of the folding system of FIG. 1.

As seen in FIG. 37, there are eleven unknowns ($b_1$-$b_{11}$) in the illustrated embodiment. The eleven equations of constraint for this embodiment are provided below.

The folding roll circumference (the folding roll makes one revolution every N products and $h=V_p/V_f$):

$$(h-1)b_3 + (1-h)b_6 = \frac{4\pi R_3}{V_f} - 2hN \tag{4}$$

The leading end of the product reaches the folding roll at the 6 O'clock position at same time as the trailing end of the product:

$$(h-1)b_6 - 2hb_7 + (h+1)b_{10} = \frac{-2R_3(\beta + \beta_{Puck})}{V_f} \tag{5}$$

The puck of the oscillating member does not dwell at zero speed $$b_4=b_5 \tag{6}$$

Conveyor traverses product length and center distance from fold start to fold complete:

$$-b_1 + b_7 = \frac{(L_p + Ct)}{V_p} \tag{7}$$

Puck sweep CW equals puck sweep CCW:

$$-b_1+b_2+b_4+b_5+b_6-b_8-b_9-b_{11}=0 \tag{8}$$

Puck dwells at $V_P$ for length of puck $$(b_2 - b_1) = \frac{R_2\gamma_{puck}}{V_p} \tag{9}$$

Puck travels past tangency by over travel angle:

$$2b_1 - b_2 - b_4 = \frac{-2R_2(\gamma + \gamma_{puck} + \gamma \text{ over})}{V_p} \tag{10}$$

No discontinuity in Puck slope $b_5$ to $b_6$:

$$(1-h)b_5-b_6+h\ b_{10}=0 \tag{11}$$

Final puck slope equals initial puck slope:

$$b_1+b_8-b_9-b_{11}=0 \tag{12}$$

Begin puck motion: Freely choose $b_{11}$:

$$b_{11}=y \tag{13}$$

Puck Reaches Conveyor Velocity: Freely choose $b_1$:

$$b_1=z \tag{14}$$

Puck Forward Sweep: Puck sweeps through included angle γ plus arc equal to puck length:

$$-2b_1 + b_2 + b_4 = \frac{2R_2(\gamma + \gamma_{puck})}{V_p} \tag{18}$$

Puck Matches Conveyor: Puck dwells with conveyor roll for arc equal to puck length:

$$-b_1 + b_2 + b_4 = \frac{R_2\gamma_{puck}}{V_p} \tag{19}$$

Puck Begins Accelerating: Freely choose $b_{10}$:

$$b_{10}=y \tag{20}$$

Figure 38:
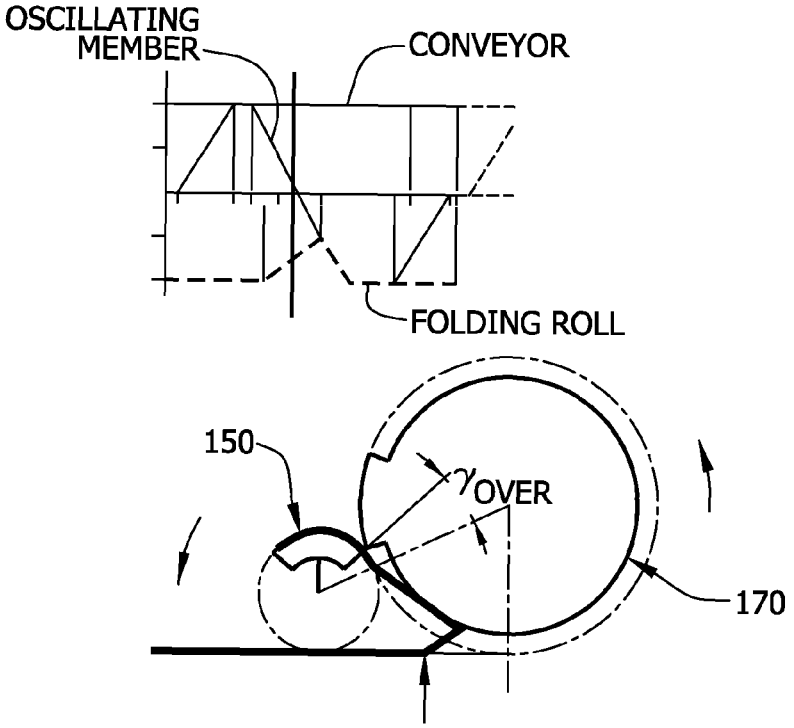
FIGS. 38 and 39 schematically and graphically illustrate movement of the oscillating member and the folding roll as they approach meeting at a tangency point.
Figure 39:
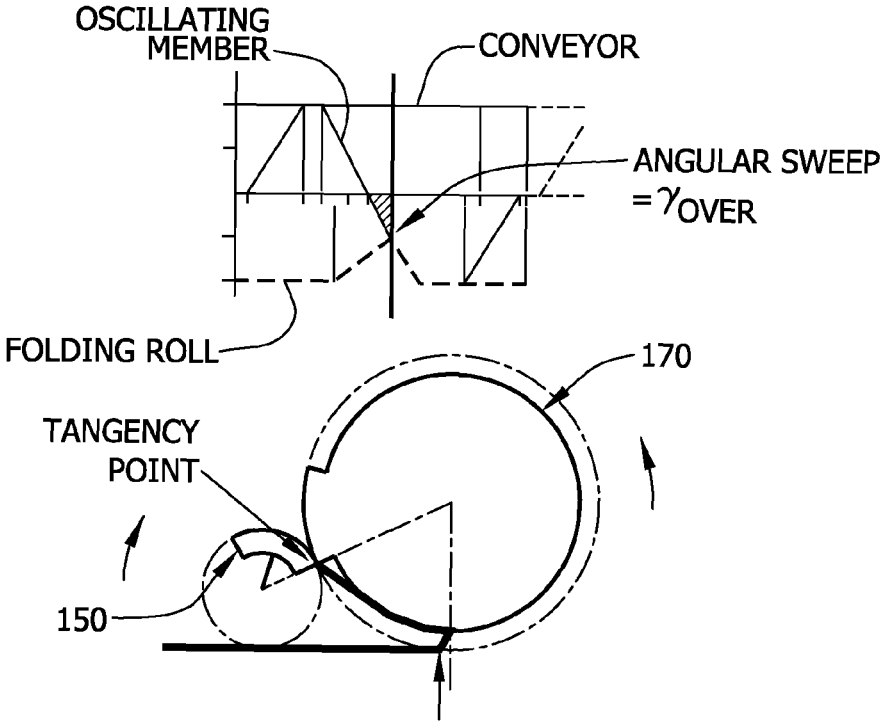
Figure 40:
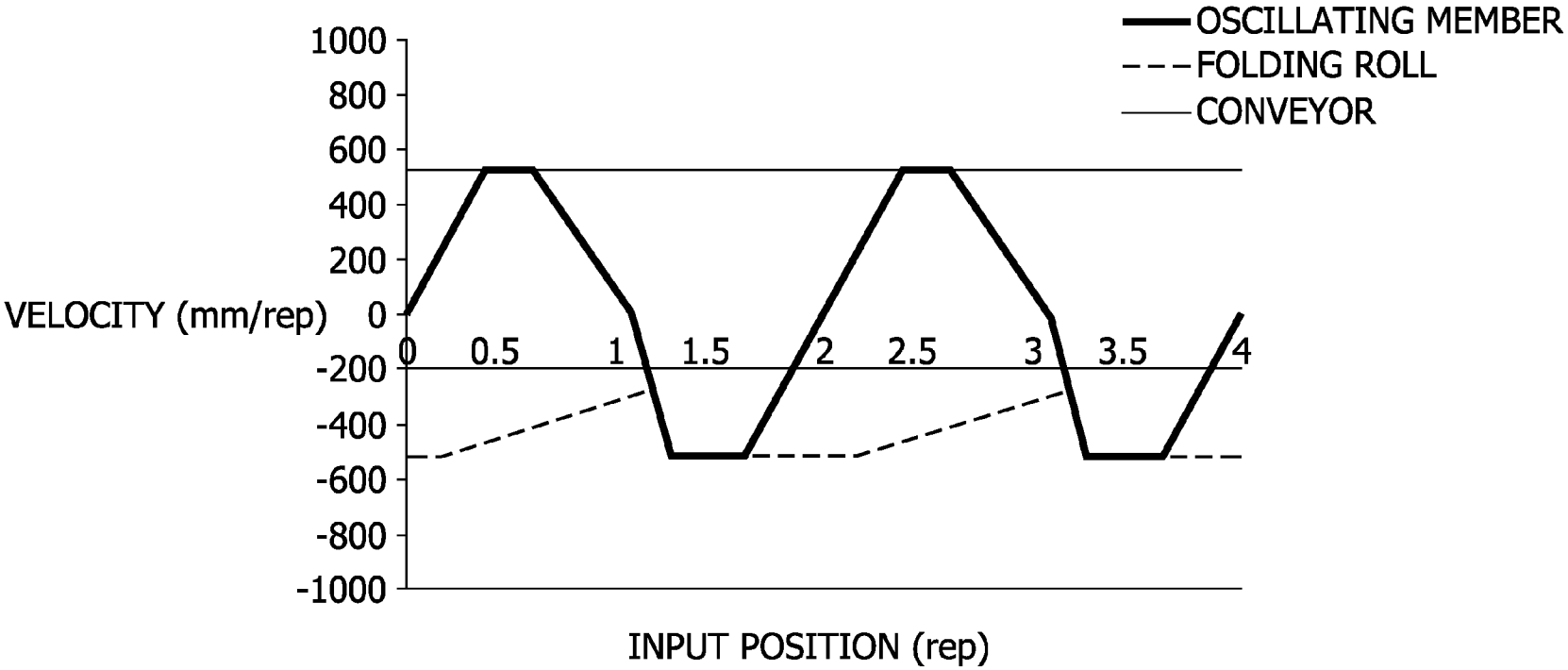
FIG. 40 graphically illustrates the velocity profiles of the folding system of FIG. 1.

In one suitable embodiment, the puck 164 of the oscillating member 150 and the folding roll 170 surfaces are moving at the same speed when they meet at the tangency point. There are not enough degrees of freedom to allow constraining the puck to reach velocity $V_f$ in a sweep angle equal to $\gamma_{over}$. However, one is free to choose $\gamma_{over}$ until the difference between the area under the velocity curve from $b_5$ to $b_{10}$ equals the puck radius times $\gamma_{over}$. See FIGS. 38 and 39. The system's velocity profiles are graphically illustrated in FIG. 40.

Folding Roll and Puck Sweep Test:

$$\left|\frac{V_p(b_{10}-b_5)}{2}-R_2\gamma_{over}\right|\cdot 1\text{ mm} \tag{21}$$

Putting the equations of constraint into matrix form we have:

$$A=\begin{bmatrix} 0 & 0 & h-1 & 0 & 0 & 1-h & 0 & 0 & 0 & 0 & 0 \\ 0 & 0 & 0 & 0 & 0 & h-1 & -2h & 0 & 0 & h+1 & 0 \\ 0 & 0 & 0 & 1 & -1 & 0 & 0 & 0 & 0 & 0 & 0 \\ 1 & 0 & 0 & 0 & 0 & 0 & -1 & 0 & 0 & 1-h & 0 \\ 1 & -1 & 0 & -1 & -1 & -1 & 0 & 1 & 1 & 0 & 1 \\ 1 & -1 & 0 & 0 & 0 & 0 & 0 & 0 & 0 & 0 & 0 \\ 2 & -1 & 0 & -1 & 0 & 0 & 0 & 0 & 0 & 0 & 0 \\ 0 & 0 & 0 & 0 & 1-h & -1 & 0 & 0 & 0 & h & 0 \\ 1 & 0 & 0 & 0 & 0 & 0 & 0 & 1 & -1 & 0 & -1 \\ 0 & 0 & 0 & 0 & 0 & 0 & 0 & 0 & 0 & 0 & 1 \\ 1 & 0 & 0 & 0 & 0 & 0 & 0 & 0 & 0 & 0 & 0 \end{bmatrix}$$

$$B=\begin{bmatrix} b_1 \\ b_2 \\ b_3 \\ b_4 \\ b_5 \\ b_6 \\ b_7 \\ b_8 \\ b_9 \\ b_{10} \\ b_{11} \end{bmatrix}$$

$$C=\begin{bmatrix} 4\pi R_3/V_f-2hN \\ -2R_3(\beta+\beta_{puck})/V_f \\ 0 \\ -(L_P+Ct)/V_p \\ 0 \\ R_2\gamma_{Puck}/V_p \\ -2R_2(\gamma+\gamma_{Puck}+\gamma_{over})/V_p \\ 0 \\ 0 \\ y \\ z \end{bmatrix}$$

The solution for the $b_i$'s in the above set of equations can be found using either Gaussian elimination or matrix inversion. The solution using matrix inversion is of the form:

$$B=A^{-1}\cdot C$$

Consider a folder with the following parameters:

| | | |
|---|---|---|
| Q = | 1000 | prod/min |
| $V_P$ = | 546.1 | mm/rep |
| $V_f$ = | 290.5405 | mm/rep |
| $L_{puck}$ = | 116.2162 | mm |
| $R_2$ = | 58.10811 | mm |

-continued

| | | |
|---|---|---|
| $R_3$ = | 151.0811 | mm |
| N = | 2 | folders |
| z = | 0.3726 | rep |
| y = | 0 | rep |
| $\gamma_{Over}$ = | 0.25617 | rad. |

The above parameters yield the following center angles:

| | |
|---|---|
| $\gamma$ = | 116.39° |
| $\beta$ = | 63.61° |

Oscillating member and folding roll puck angles:

| | |
|---|---|
| $\beta_{puck}$ = | 114.59° |
| $\gamma_{puck}$ = | 44.07° |

The timing solution in the above system is as follows:

| | |
|---|---|
| $b_1$ = | 0.3726 |
| $b_2$ = | 0.585411 |
| $b_3$ = | 0.146265 |
| $b_4$ = | 1.072221 |
| $b_5$ = | 1.072221 |
| $b_6$ = | 1.264827 |
| $b_7$ = | 1.715748 |
| $b_8$ = | 1.62474 |
| $b_9$ = | 1.99734 |
| $b_{10}$ = | 1.174693 |
| $b_{11}$ = | 0 |

Figure 41:
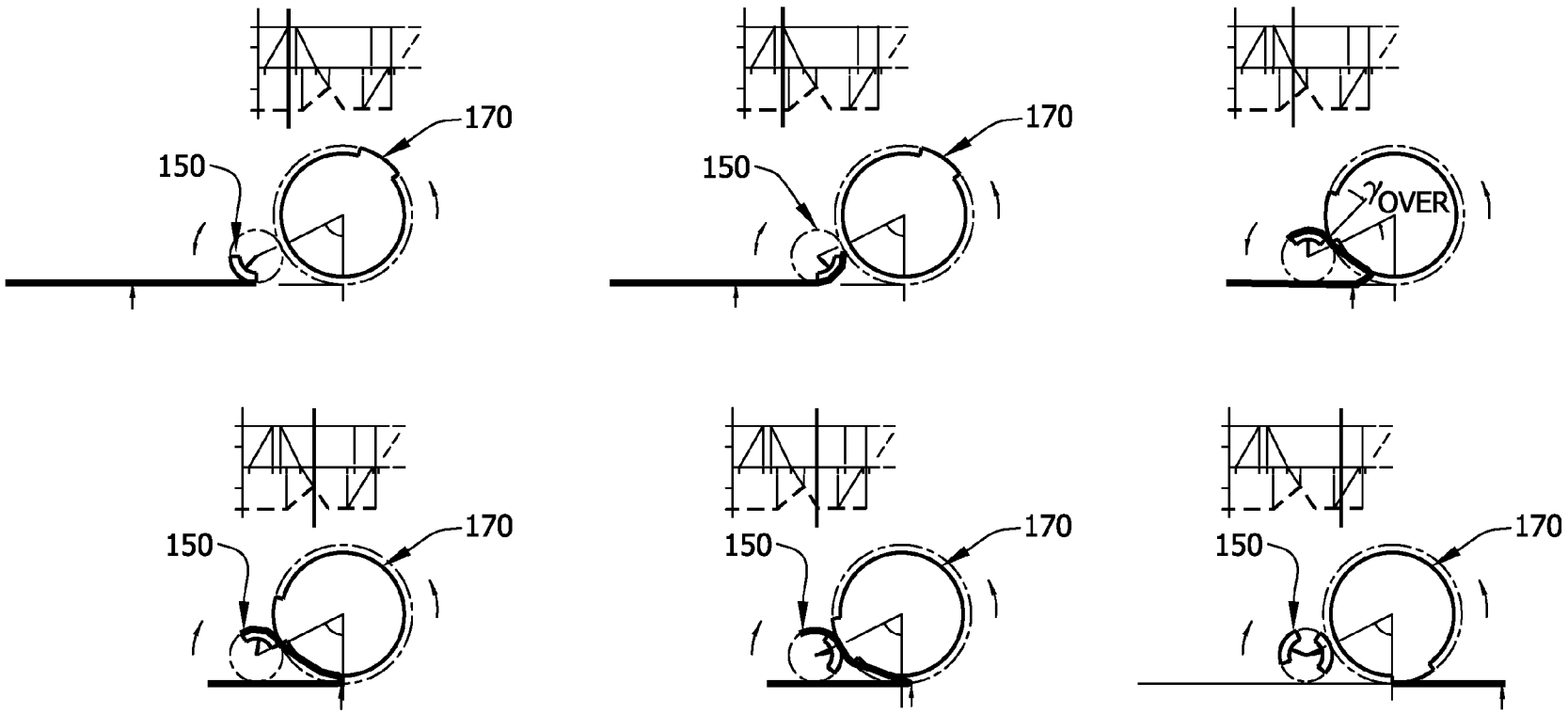
FIG. 41 illustrates six transitions point of the system of FIG. 1.

FIG. 41 illustrates six transitions point of the system 50. Each of the transition points are also illustrated in FIGS. 29-34, respectively. Table 2 provides the estimated torques on the oscillating roll 150 (or puck 164) and the folding roll 170 while operating the system 50 at approximately 1000 products per minute. The estimated torques are provided for the oscillating roll 150 and folding roll 170 having each of the radii provided in Table 1.

TABLE 2

| | rad/sec$^2$ | Size 3.5 | Size 3 | Size 2 | |
|---|---|---|---|---|---|
| PUCK | | | | | |
| Accel | 7,006 | 234 | 207 | 160 | lb - in |
| Decel | −13,554 | −453 | −400 | −310 | lb - in |
| TRANSFER ROLL | | | | | |
| Accel | 457 | 482 | 414 | 299 | lb - in |
| Decel | −5,213 | −5,501 | −4,725 | −3,410 | lb - in |

Other apparatus suitable for holding, controlling, transferring, folding, winding and/or otherwise handling flexible materials and articles (including training pants) are described in U.S. patent application Ser. No. 12/972,012 entitled FOLDING APPARATUS AND METHOD OF FOLDING A PRODUCT; U.S. patent application Ser. No. 12/972,037 entitled FOLDING APPARATUS HAVING ROLLS WITH VARIABLE SURFACE SPEEDS AND A METHOD OF FOLDING A PRODUCT); and U.S. patent application Ser. No. 12/972,082 entitled VACUUM ROLL AND METHOD OF USE. Each of these applications is incorporated herein by reference in their entireties.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An apparatus for folding a product having a first portion, a second portion, an unfolded configuration, and a folded configuration wherein one of the first and second portions overlies the other portion, the apparatus comprising:

a conveying member adapted to convey the product;

an oscillating member being disposed adjacent the conveying member and adapted to grasp and lift the first portion of the product from the conveying member while the product is being conveyed by the conveying member, the oscillating member being moveable in a first direction away from the conveying member and in a second direction toward the conveying member; and a folding roll disposed adjacent the conveying member and the oscillating member, the folding roll being adapted to receive the first portion of the product from the oscillating member and to place the first portion of the product into engagement with the second portion of the product such that the product is in the folded configuration.

2. The apparatus as set forth in claim 1 wherein the conveying member is adapted to hold the second portion of the product while the first portion of the product is placed into engagement with the second portion of the product by the folding roll.

3. The apparatus as set forth in claim 1 wherein the conveying member and oscillating member define a first nip, the oscillating member being adapted to receive the first portion of the product from the oscillating member at the first nip.

4. The apparatus as set forth in claim 3 further comprising a bump roll configured to contact the conveying member adjacent the first nip.

5. The apparatus as set forth in claim 4 wherein the bump roll is rotatable and comprises a raised engagement surface for intermittently contacting the conveying member as the bump roll rotates.

6. The apparatus as set forth in claim 3 wherein the folding roll and oscillating member define a second nip, the oscillating member being adapted to transfer the first portion of the product to the folding roll at the second nip.

7. The apparatus as set forth in claim 6 wherein the folding roll and the conveying member define a third nip, the folding roll being adapted to transfer the first portion to the conveying member at the third nip.

8. The apparatus as set forth in claim 1 wherein the conveying member comprises a vacuum belt conveyor, the oscillating member comprises a vacuum roll, and the folding roll comprises a vacuum roll.

9. The apparatus as set forth in claim 1 wherein the conveying member is configured to convey the product at a constant speed.

10. The apparatus as set forth in claim 9 wherein the oscillating member is configured to move at a variable speed.

11. The apparatus as set forth in claim 1 wherein the product comprises a pair of first fastening components located in the first portion of the product and a pair of second fastening components located in the second portion of the product, the folding roll being adapted to securely engage each of the first fastening components of the product with a respective one of the second fastening components of the product when the folding roll places the first portion of the product into engagement with the second portion of the product.

* * * * *